US011302461B2

(12) United States Patent
Kawase et al.

(10) Patent No.: US 11,302,461 B2
(45) Date of Patent: Apr. 12, 2022

(54) METHOD AND DEVICE FOR PRODUCING WIRE HARNESS

(71) Applicant: Hitachi Metals, Ltd., Tokyo (JP)

(72) Inventors: Kenji Kawase, Tokyo (JP); Masaru Ishikawa, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/864,990

(22) Filed: May 1, 2020

(65) Prior Publication Data

US 2020/0357541 A1 Nov. 12, 2020

(30) Foreign Application Priority Data

May 10, 2019 (JP) ..... JP2019-089965

(51) Int. Cl.
*H01B 13/012* (2006.01)

(52) U.S. Cl.
CPC . *H01B 13/01209* (2013.01); *H01B 13/01245* (2013.01)

(58) Field of Classification Search
CPC ..... H01B 13/01209; H01B 13/01245
See application file for complete search history.

(56) References Cited

U.S. PATENT DOCUMENTS 9,257,808 B1 * 2/2016 Guglielmo ..... H01B 13/01245
2008/0079656 A1 * 4/2008 Kee ..... G06F 1/1641 345/1.3
2009/0265923 A1 * 10/2009 MaClean ..... H01B 13/01227 29/729

(Continued)

FOREIGN PATENT DOCUMENTS

CN 207742597 U * 8/2018 ..... G06F 1/16
EP 3 477 512 A1 5/2019
JP 2015-200701 A 11/2015
JP 2018084542 A * 5/2018 ..... H01B 12/012
JP 2018198219 A * 12/2018 ..... H01B 13/02

(Continued)

OTHER PUBLICATIONS

Extended European Search Report dated Sep. 15, 2020 for European Patent Application No. 20172827.6-1201.

*Primary Examiner* — Peter Dungba Vo
*Assistant Examiner* — Jose K Abraham
(74) *Attorney, Agent, or Firm* — McGinn IP Law Group, PLLC

(57) ABSTRACT

A wire harness producing method configured to produce a wire harness by arranging a plurality of display devices end to end, each including a display portion and a bezel arranged around a periphery of the display portion, displaying a wire laying-out drawing on the display devices, and laying out an electric wire along the wire laying-out drawing. The method includes compartmentalizing a two-dimensional image of the wire harness into display regions to be displayed on the display portions of the display devices respectively and non-display regions corresponding to the bezels of the display devices respectively, with the display regions and the non-display regions conforming to sizes of the display portions and the bezels respectively, trimming the two-dimensional image to create wire laying-out image data composed of only the display regions, and displaying the wire laying-out drawing on the display devices, based on the wire laying-out image data.

17 Claims, 15 Drawing Sheets

(56) References Cited

U.S. PATENT DOCUMENTS

| | | | | |
|---|---|---|---|---|
| 2011/0310070 | A1* | 12/2011 | Zeng | G06F 3/1423 345/204 |
| 2013/0144418 | A1* | 6/2013 | Tsuchiya | G06F 30/15 700/98 |
| 2015/0161781 | A1* | 6/2015 | Philbert | G06F 30/00 382/141 |
| 2016/0064121 | A1 | 3/2016 | Rougier et al. | |
| 2016/0197134 | A1* | 7/2016 | Jung | H01L 27/3218 257/40 |
| 2019/0118741 | A1 | 4/2019 | Kawase et al. | |

FOREIGN PATENT DOCUMENTS

| | | | | |
|---|---|---|---|---|
| JP | 2019-040881 | A | 3/2019 | |
| WO | WO-2012035988 | A1 * | 3/2012 | G02F 1/13336 |

* cited by examiner

FIG. 4

172

| Step No. | ... | FROM | | | ... | TO | | | ... | Cable name | Cut Length | Cable P/N No. | X-From | Y-From | X-To | Y-To | ... |
|---|---|---|---|---|---|---|---|---|---|---|---|---|---|---|---|---|---|
| | | Side | Side Label Character | Ring mark | | Ring mark | Side Label Character | Side | | | | | | | | | |
| 1 | | | | | | | | | | | | | | | | | |
| 2 | | | | | | | | | | | | | | | | | |
| 3 | | | | | | | | | | | | | | | | | |
| 4 | | | | | | | | | | | | | | | | | |
| 5 | | | | | | | | | | | | | | | | | |
| ... | | | | | | | | | | | | | | | | | |

174

FIG. 16

Scan Traceability Report

Part Number : EH***  Version 01 / 0003  Drawing No. **  File **
Production Id : 681** / 34* / ******  Start 2019/03/04 11:51  Finish 2019/03/04 12:52  Line Line4
Operators : 1.aaaa 2.bbbb 3.cccc
Total 1h 33s

Scanned Data

| Side | Item/Operation | Date | Additional Info | Length | Scanned | Time[s] | More Info |
|---|---|---|---|---|---|---|---|
| | Process | 2019/03/04 12:52 | | | ***Finish*** | | |
| | Process | 2019/03/04 12:36 | Inspection | | Finish | 321 | |
| | Process | 2019/03/04 12:31 | Inspection | | Start | | |
| | ⋮ | ⋮ | ⋮ | | ⋮ | | |
| C | A:50MN15C | 2019/03/04 12:14 | Wire Conductivity | 5510 | 1.0515E+00 | 30/30 | |
| C | A:50MN15C | 2019/03/04 12:13 | CAB-***-**** | 5510 | | 9 | |
| C | A:50MN15C | 2019/03/04 12:13 | CAB-***-**** | 5510 | | | |
| C | A:50MN15C | 2019/03/04 12:13 | CAB-***-**** | 5510 | Scan | | |
| | ⋮ | ⋮ | ⋮ | | ⋮ | | |

METHOD AND DEVICE FOR PRODUCING WIRE HARNESS

CROSS-REFERENCE TO RELATED APPLICATION

The present application is based on Japanese patent application No. 2019-089965 filed on May 10, 2019, the entire contents of which are incorporated herein by reference.

BACKGROUND OF THE INVENTION

1. Field of the Invention

The present invention relates to a method and a device for producing a wire harness.

2. Description of the Related Art

A wire harness designed to be used in a train vehicle such as a train or the like is configured with a plurality of electric wires being bundled together therein. In producing the wire harness, the wire harness is assembled by cutting each of the plurality of electric wires to a preset electric wire length, laying them out along a full scale wire laying out drawing, and fitting the laid out electric wires or the bundle of the laid out electric wires with a component to be attached at a predetermined position thereon (see e.g. US Patent Application Publication No. 2016/0064121 A1).

US Patent Application Publication No. 2016/0064121 A1 discloses a method of displaying a full scale wire laying out drawing (a full scale wire laying out image) on a display, and laying out electric wires along the wire laying out image.

[Patent Document 1] US Patent Application Publication No. 2016/0064121 A1

SUMMARY OF THE INVENTION

In displaying the wire laying out image on the display as described above, efficiently utilizing the display is desired. In particular, since the wire harness designed to be used in a train vehicle such as a train or the like may be required to have a very long overall length of several tens of meters, the efficient utilization of the display is required.

Accordingly, it is an object of the present invention to provide a wire harness producing method and a wire harness producing device, that are configured to be able to efficiently utilize a display.

For the purpose of solving the above-described problems, the present invention provides a wire harness producing method, which is configured to produce a wire harness by arranging a plurality of display devices end to end, each configured to include a display portion and a bezel portion arranged around a periphery of the display portion, displaying a wire laying out drawing in a full size in a length direction on the plurality of display devices, and laying out an electric wire along the wire laying out drawing, the method comprising: compartmentalizing a pre-created two-dimensional image of the entire wire harness into display regions to be displayed on the respective display portions of the plurality of display devices respectively and non-display regions corresponding to the respective bezel portions of the plurality of display devices respectively, with the display regions and the non-display regions conforming to sizes of the respective display portions and the respective bezel portions, respectively, of the plurality of display devices; trimming the two-dimensional image to create wire laying out image data composed of only the display regions for the wire laying out drawing; and displaying the wire laying out drawing on the plurality of display devices on the basis of the wire laying out image data having been created.

Further, for the purpose of solving the above-described problems, the present invention provides a wire harness producing device, which is configured to produce a wire harness by arranging a plurality of display devices end to end, each configured to include a display portion and a bezel portion arranged around a periphery of the display portion, displaying a wire laying out drawing in a full size on the plurality of display devices, and laying out an electric wire along the wire laying out drawing, the device comprising: a compartmentalizing section configured to compartmentalize a pre-created two-dimensional image of the entire wire harness into display regions to be displayed on the respective display portions of the plurality of display devices respectively and non-display regions corresponding to the respective bezel portions of the plurality of display devices respectively, with the display regions and the non-display regions conforming to sizes of the respective display portions and the respective bezel portions, respectively, of the plurality of display devices; a wire laying out image data creating section configured to trim the two-dimensional image to create wire laying out image data composed of only the display regions for the wire laying out drawing; and a displaying control section configured to display the wire laying out drawing on the plurality of display devices on the basis of the wire laying out image data having been created in the wire laying out image data creating section.

Points of the Invention

According to the present invention, it is possible to provide the wire harness producing method and the wire harness producing device, that are configured to be able to efficiently utilize the display devices.

BRIEF DESCRIPTION OF THE DRAWINGS

FIG. 3A is a schematic diagram showing an arrangement of display devices and the transparent protecting covers, FIG. 3B is a side view showing a joined portion between the transparent protecting covers, FIG. 3C and FIG. 3D are side views showing modifications, respectively, to the joined portion therebetween shown in FIG. 3B, and FIG. 3E is a perspective view showing a protective tape provided on the joined portion between the transparent protecting covers;

FIG. 4 is a diagram showing one example of operation recipe information;

FIG. 9 is a diagram for explaining an effect of putting some of the display devices into a sleep mode or the like;

FIG. 16 is a diagram showing one example of operation history information.

DETAILED DESCRIPTION OF THE PREFERRED EMBODIMENTS

Embodiment

An embodiment of the present invention will be described below in conjunction with the accompanying drawing.

Figure 1:
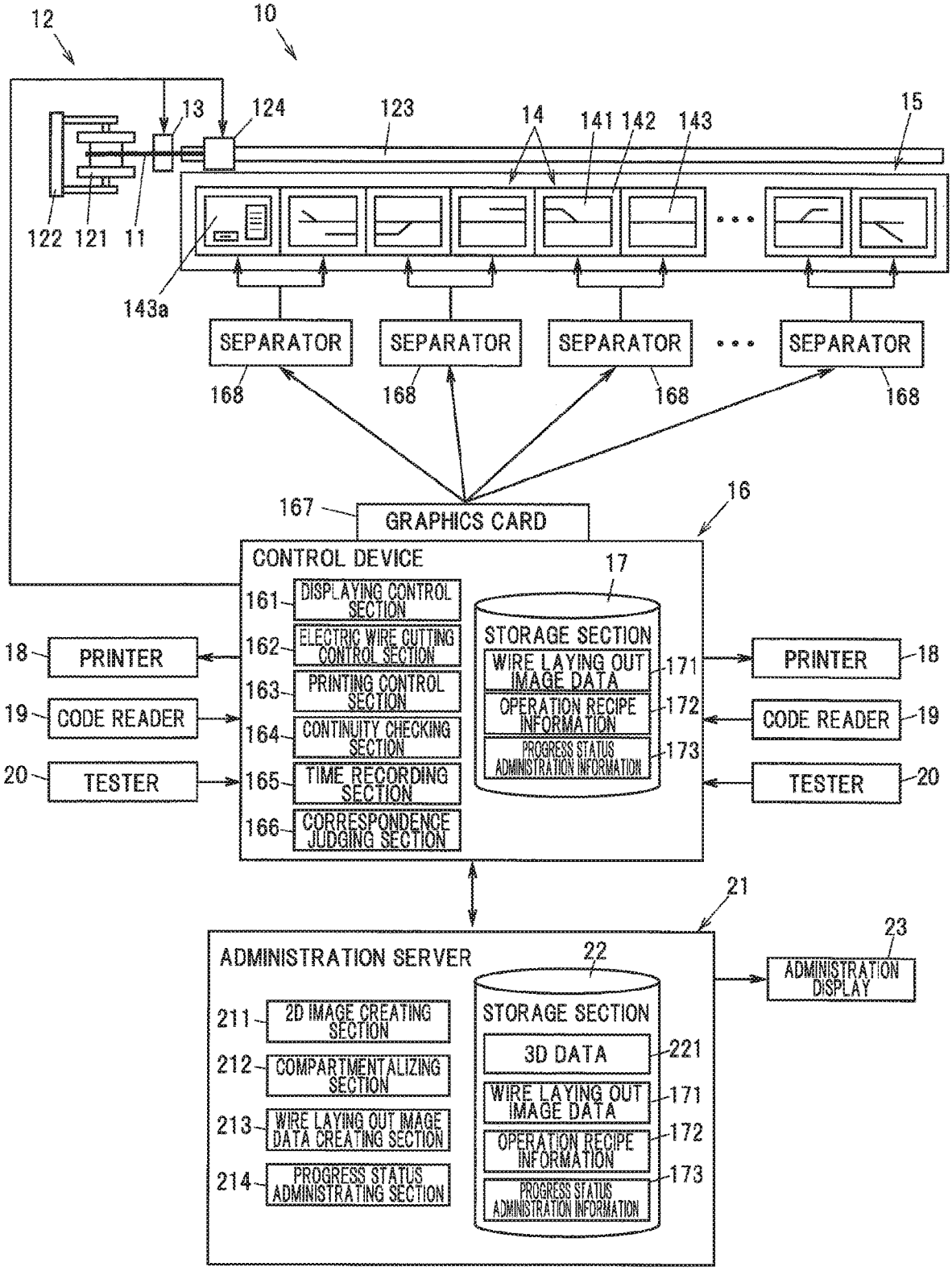
FIG. 1 is a schematic configuration diagram of a wire harness producing device according to one embodiment of the present invention.

FIG. 1 is a schematic configuration diagram of a wire harness producing device 10 according to the present embodiment. A wire harness to be produced in the present embodiment is designed to be used in, e.g., wiring between devices in a train.

As shown in FIG. 1, the wire harness producing device 10 is a device configured to produce the wire harness by arranging a plurality of display devices 14 end to end, each configured to include a display portion 141 and a bezel portion 142 arranged around a periphery of the display portion 141, displaying a wire laying out drawing (a wire laying out image) 143 in a full size on the plurality of display devices 14, and laying out an electric wire 11 along the wire laying out drawing 143.

The wire harness producing device 10 is configured to include an electric wire feeding device 12, an electric wire cutting machine 13, which is configured to cut the electric wire 11 fed from the electric wire feeding device 12, a work bench 15, which is composed of the plurality of display devices 14 arranged end to end, and a control device 16, which is configured to perform a control on the electric wire feeding device 12 and the electric wire cutting machine 13, and a displaying control on the plurality of display devices 14, and the like.

The electric wire 11 is configured as a linear shape conductor coated with an electrical insulating member around its outer periphery, but that electric wire 11 may, as with a LAN cable, integrally be configured in such a manner that a plurality of the linear shape conductors are coated with the electrical insulating members around their outer peripheries respectively, and then covered together with an outer sheath therearound. Here, the electrical insulating members are made of an electrically insulative resin and may be configured as one layer or a plurality of layers. The outer sheath may be formed by solid extrusion in such a manner as to impregnate the spaces between the electrical insulating members, or may be formed in a tubular shape.

The electric wire feeding device 12 is configured to include a reel 121 with the electric wire 11 being wound therearound, a supporting member 122, which is configured to pivotably support the reel 121, and a transfer robot 124, which is configured to hold that electric wire 11 fed from the reel 121, run on a rail 123, and transfer (pull out) that electric wire 11. The reel 121 is fitted with an electric wire identification code (not shown), which is configured to identify a type of the electric wire 11 being wound therearound. The rail 123 is configured to be provided above the work bench 15, and being fixed to the work bench 15.

The electric wire cutting machine 13 is configured to use a built-in cutting blade (not shown), to cut that electric wire 11 pulled out by the transfer robot 124. The type of the electric wire 11 to be laid out can be altered by altering the reel 121 supported by the supporting member 122. A feeder, though not shown, is provided in the subsequent stage of the reel 121, and the length of the electric wire 11 pulled out by that feeder is measured. Note that the electric wire feeding device 12 may not be provided with the transfer robot 124, and that the electric wire 11 fed out from the feeder may be pulled out by human hand. Further, no feeder may be provided, and the electric wire 11 may be pulled out from the reel 121 by human hand.

The work bench 15 is configured as a bench designed for a wire laying out operation for the electric wire 11 to be performed thereon, and being provided with the plurality of display devices 14 on its top surface, for displaying a full scale wire laying out image. Since the wire harness for a train vehicle is very long, e.g., 30 m, the work bench 15 is constituted by arranging the plurality of display devices 14 end to end in one row. Herein, the work bench 15 is constituted by arranging 24 of the display devices 14 end to end in one row. Note that the number of the display devices 14 to be arranged end to end on the work bench 15 is not limited to the above number. Also, the arrangement of the plurality of display devices 14 is not limited to the illustrated one, but can appropriately be altered according to the shape of the wire harness to be produced. For example, the plurality of display devices 14 may be arranged in rows and columns in a matrix.

Figure 2A:
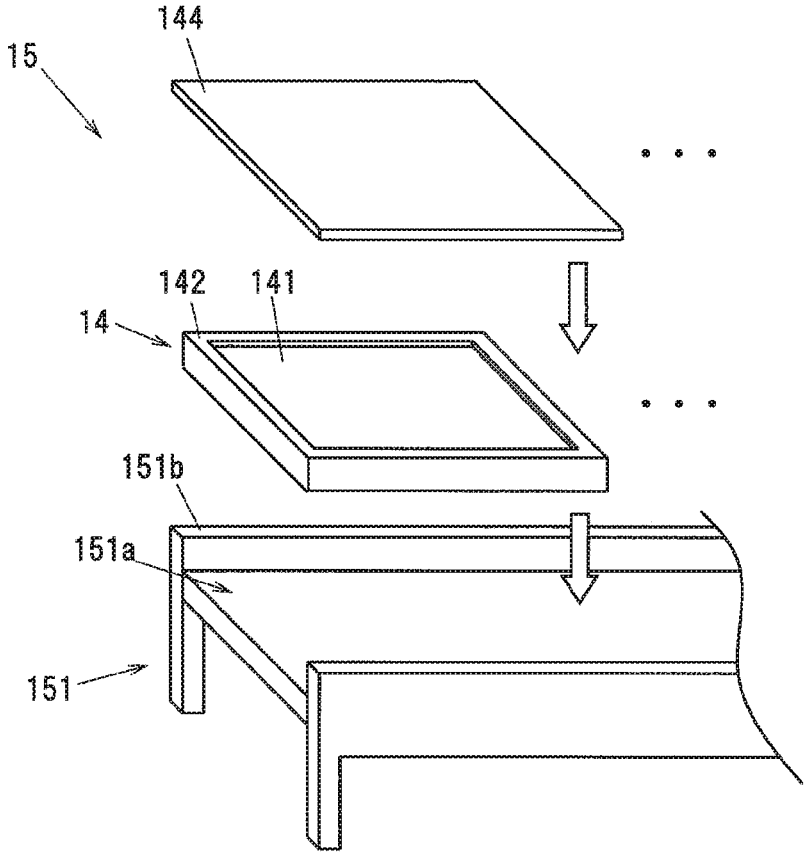
FIG. 2A is an exploded perspective view showing a work bench.
Figure 2B:
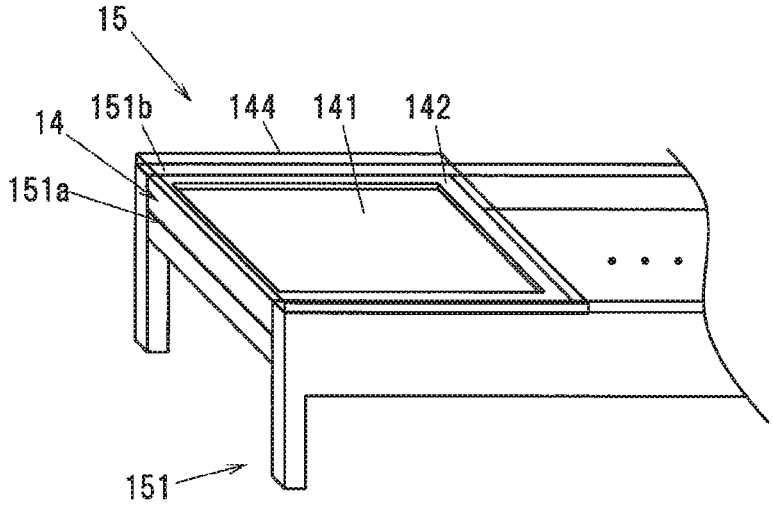
FIG. 2B is a perspective view showing the work bench.

The plurality of display devices 14 are made of, e.g., a liquid crystal display or the like. As shown in FIGS. 2A and 2B, the work bench 15 has a frame 151 having a recessed receiving portion 151*a* for the plurality of display devices 14 to be set therein, and is constituted by the plurality of display devices 14 being received in the receiving portion 151*a* from above the frame 151. Plate-shape transparent protecting covers 144 are provided on the plurality of display devices 14, respectively, to protect the respective display portions 141 of the plurality of display devices 14. The transparent protecting covers 144 are made of a transparent member such as an acrylic or the like. A wire harness production is performed by laying out the electric wire 11 cut by the electric wire cutting machine 13 on the transparent protecting covers 144 in such a manner as to allow the electric wire 11 to follow the wire laying out drawing 143 displayed on the plurality of display devices 14, and subsequently appropriately performing tape wrapping, protective material mounting, and the like.

The transparent protecting covers 144 are provided on the plurality of display devices 14, respectively, in such a manner as to cover uneven surfaces between the respective display portions 141 and the respective bezel portions 142 of the plurality of display devices 14. The transparent protecting covers 144 serve to protect the respective display portions 141 of the plurality of display devices 14 from being damaged, and to suppress the damage of the electric wire 11 to be laid out due to interfering with the uneven surfaces between the respective display portions 141 and the respective bezel portions 142 of the plurality of display devices 14.

The plurality of display devices 14 may be provided with one transparent protecting cover 144, but in this case, in the event of damage to the one transparent protecting cover 144, replacing the one transparent protecting cover 144 is wasteful, or in the event of a fault in the display devices 14, replacing the display devices 14 is time consuming. In light of the foregoing, in the present embodiment, the transparent protecting covers 144 are each individually being provided for each of the plurality of display devices 14. The transparent protecting covers 144 can be detached upward from the display devices 14. By detaching the transparent protecting covers 144 from the display devices 14, the display devices 14 can also be detached upward from the frame 151 of the work bench 15. Thus, even when the work space is narrow, the transparent protecting covers 144 or the display devices 14 can easily be replaced. Note that even when the plurality of display devices 14 are arranged in a matrix, the transparent protecting covers 144 can be applied thereto.

The lengths of the transparent protecting covers 144 in a direction of the arrangement of the plurality of display devices 14 arranged end to end in one row are configured to be substantially equal to those of the plurality of display devices 14. Further, the widths of the transparent protecting covers 144 in a width direction perpendicular to the direction of the arrangement of the plurality of display devices 14 arranged end to end in one row are configured to be slightly larger than those of the plurality of display devices 14. The transparent protecting covers 144 are fixed to the frame 151 of the work bench 15 by fixing respective two projecting end portions of the transparent protecting covers 144 being projected from the plurality of display devices 14 in the width direction of the plurality of display devices 14 to two edge portions 151*b* of the frame 151 with screws or the like. Note that the transparent protecting covers 144 for the plurality of display devices 14 may or may not be contiguous to the respective bezel portions 142 of the plurality of display devices 14.

Figure 3A:
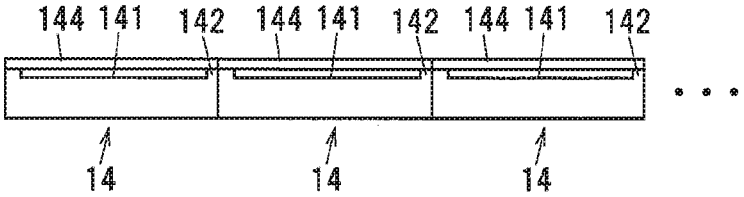
FIGS. 3A to 3E are diagrams for explaining arrangements of transparent protecting covers, where
Figure 3B:
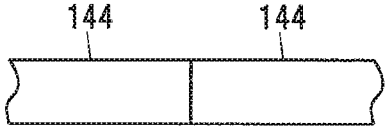
Figure 3C:
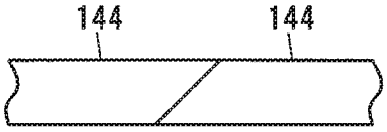
Figure 3D:
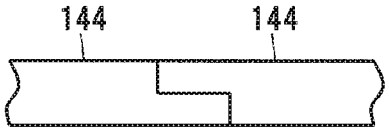

As shown in FIGS. 3A and 3B, in the present embodiment, the end faces of adjacent ones of the transparent protecting covers 144 for the plurality of display devices 14 are butted together. In FIGS. 3A and 3B is shown a case in which the end faces of the transparent protecting covers 144 for the plurality of display devices 14 are the faces perpendicular to the surfaces of the transparent protecting covers 144, but as shown in FIG. 3C, the end faces of the transparent protecting covers 144 may be inclined with respect to the surfaces of the transparent protecting covers 144. Alternatively, as shown in FIG. 3D, the end portions of the transparent protecting covers 144 may be formed in a step shape so as to be able to suppress the occurrence of a positional misalignment in the adjacent ones of the transparent protecting covers 144. Further, a locking structure, though not shown, may be provided on the end portions of the transparent protecting covers 144 so as to lock the adjacent ones of the transparent protecting covers 144 to each other.

Figure 3E:
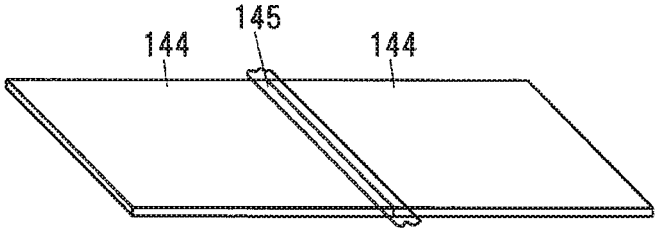

Furthermore, as shown in FIG. 3E, a transparent protective tape 145 may be provided on joined portions between the adjacent ones of the transparent protecting covers 144. The protective tape 145 is a tape configured to suppress the damage of the electric wire 11 to be laid out due to interference with the end portions of the transparent protecting covers 144, in the event of an uneven surface formation at the joined portions between the adjacent ones of the transparent protecting covers 144 due to a manufacturing tolerance or the like, or in the event of the end portions of the transparent protecting covers 144 being separated from each other for some reason.

It is desirable that the joined portions between the adjacent ones of the transparent protecting covers 144 for the plurality of display devices 14 be located on the respective bezel portions 142 of the plurality of display devices 14. This is because if the joined portions between the adjacent ones of the transparent protecting covers 144 lie on the respective display portions 141 of the plurality of display devices 14, it may be difficult to read in a code with a code reader 19, which will be described later.

In order to suppress the eyestrain of an operator, the transparent protecting covers 144 for the plurality of display devices 14 may each be configured in such a manner as to include a blue light blocking layer that attenuates or blocks blue light having a wavelength of 380 nm to 500 nm. Further, the transparent protecting covers 144 may each be configured in such a manner as to include on their surfaces a reflection suppressing layer for suppressing the occurrence of reflected glare of external lighting or the like.

The control device 16 is a device configured to perform a control on the electric wire feeding device 12 and the electric wire cutting machine 13, and a displaying control on the plurality of display devices 14, and the like, and is configured as an appropriate combination of a computing element, a memory, an interface, a hard disk, a software and the like. In the present embodiment, the control device 16 is configured to use a personal computer.

The control device 16 is configured to include a storing section 17 that is configured to store wire laying out image data 171, operation recipe information 172, and the like. The wire laying out image data 171 is configured as image data for the wire laying out drawing 143 to be displayed on the plurality of display devices 14. The operation recipe information 172 is configured as a database with wire laying out order numbers of the electric wires 11 being time series ordered therein. In other words, the operation recipe information 172 is a database of each kind of information on all of the electric wires 11 to be laid out having been sorted in an order in which those electric wires 11 are to be laid out. Note that the present invention is not limited to the foregoing, but that the wire laying out order numbers may be stored in that database for each of the electric wires 11, and that it is not essential that each kind of information on all of the electric wires 11 to be laid out is sorted in the wire laying out order of the electric wires 11 within the database.

As shown in FIG. 4, in the operation recipe information 172, for each one of the electric wires 11 to be laid out, for example, a name (Cable name) of each one of the electric wires 11, an electric wire length design value (Cut Length) of each one of the electric wires 11, and a production number (Cable P/N No.) for denoting a type of each one of the electric wires 11 are configured. Further, in the operation recipe information 172, for example, for each of respective two end portions (From and To) of each one of the electric wires 11 to be laid out, a ring mark number (Ring mark) of each one of the electric wires 11 which will be described later, a side (Side) for indicating a position of one or the other of the respective two end portions of each one of the electric wires 11 and denoting a connection destination area (e.g., a connection destination device or the like) of each one of the electric wires 11, and the like are configured. Further, in the present embodiment, the operation recipe information 172 is configured to include coordinate information for indicating two displaying positions for an identification code (a bar code), which will be described later, for each one of the electric wires 11 to be laid out. The operation recipe information 172 is configured to include two pieces of coordinate information of the vicinities of the respective two end portions of each one of the electric wires 11 to be laid out. An X-From and a Y-From in FIG. 4 denote an X coordinate and a Y coordinate respectively indicating the respective identification code displaying position adjacent to one of the respective two end portions of each one of the electric wires 11 to be laid out. An X-To and a Y-To in FIG. 4 denote an X coordinate and a Y coordinate respectively indicating the respective identification code displaying position adjacent to the other one of the respective two end portions of each one of the electric wires 11 to be laid out. Further, the operation recipe information 172 may be configured in such a manner as to include coordinate information of branching positions of the electric wires 11, and coordinate information of the respective two end portions of each one of the electric wires 11. Note that the specific contents of the operation recipe information 172 are not limited to the foregoing, but can appropriately be configured.

The control device 16 is configured to include a displaying control section 161, which is configured to perform a displaying control on the plurality of display devices 14 of the work bench 15, an electric wire cutting control section 162, which is configured to perform a cutting control on those electric wires 11, a printing control section 163, which is configured to print, with two printers 18, identification marks to be attached to the respective two end portions respectively of each one of those electric wires 11, and a continuity checking section 164 that is configured to perform a continuity checking processing on each one of those electric wires 11. The control device 16 is configured in such a manner that the plurality of display devices 14 of the work bench 15, two code readers 19, the transfer robot 124, the electric wire cutting machine 13, the two printers 18, and two continuity checking testers 20 are connected to the control device 16.

The displaying control section 161 of the control device 16 is configured to display a full scale wire laying out image on each of the plurality of display devices 14 of the work bench 15, on the basis of the wire laying out image data 171 stored in the storing section 17 of the control device 16. The details of the displaying of the wire laying out drawing 143 will be described later.

In addition, in the present embodiment, the displaying control section 161 of the control device 16 is configured to look up the operation recipe information 172, and in turn display the identification codes on the plurality of display devices 14 of the work bench 15 in accordance with the wire laying out order of the electric wires 11. In addition, the displaying control section 161 of the control device 16 is configured to erase the display of the identification code associated with the electric wires 11 having been laid out. That is, the displaying control section 161 of the control device 16 is configured to display only the identification information on the electric wire 11 currently being laid out.

Figure 5A:
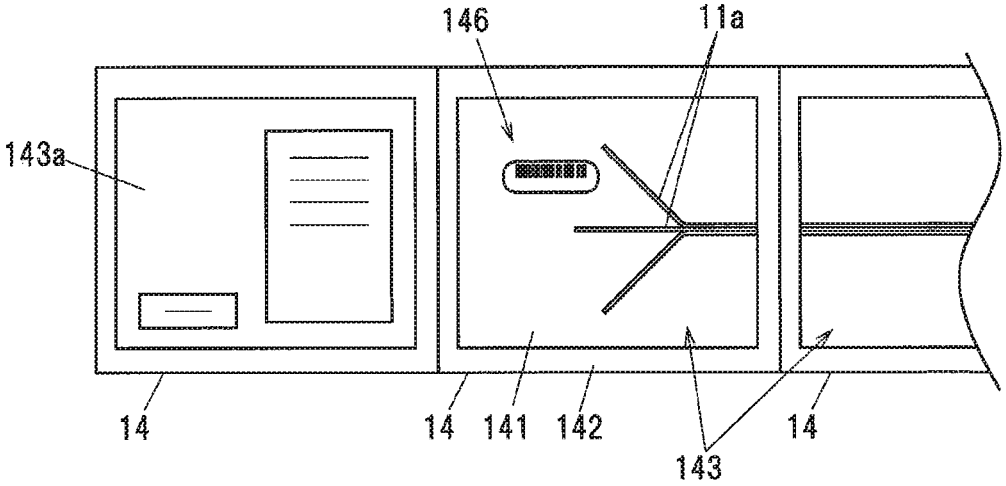
FIG. 5A is a diagram showing a display example on the display devices.
Figure 5B:
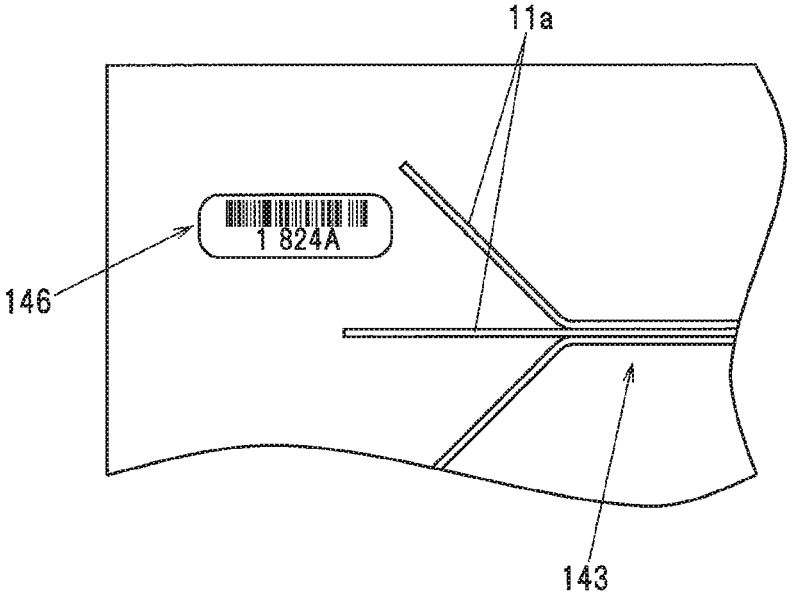
FIG. 5B is an enlarged view showing an essential portion of the display example shown in FIG. 5A.

As shown in FIGS. 5A and 5B, in the present embodiment, the displaying control section 161 of the control device 16 is configured to create a bar code (a pop-up bar code) 146 configured to be able to identify those electric wires 11 to be laid out, and display that created bar code 146 on coordinates designated according to the coordinate information in the operation recipe information 172 of the wire laying out drawing 143. The bar code 146 is configured to be created from character information in the operation recipe information 172, for example, number information in a ring mark. Also, the bar code 146 may be configured in such a manner as to be created from other information included in the operation recipe information 172, and may be configured in such a manner as to include a plurality of pieces of information. The bar code 146 is displayed in such a manner as to be superimposed on the wire laying out drawing 143. The wire laying out drawing 143 is configured to include electric wire images 11*a* of a plurality of the laid out electric wires 11. Since those electric wires 11 have their two end portions, the two bar codes 146 are displayed adjacent to the two end portions, respectively, of those electric wires 11 on the wire laying out drawing 143. Note that the displaying control section 161 of the control device 16 may be configured in such a manner as to prestore the image information in the two bar codes 146 in the operation recipe information 172, and act to retrieve that image information in the two bar codes 146 and display the two bar codes 146 on the designated coordinates. Note that the identification codes to be displayed by the displaying control section 161 of the control device 16 are not limited to the bar codes 146, but may be, e.g., a two-dimensional code (a QR code (registered trademark)).

The wire laying out drawing 143 is displayed on the plurality of display devices 14 of the work bench 15 in such a manner that the lengths of those electric wires 11 (the lengths of the electric wire images 11*a*) on the wire laying out drawing 143 are the full scale lengths of those electric wires 11. Note that the thicknesses of the electric wire images 11*a* may be thicker or thinner than the full scale thicknesses of the electric wires 11. By displaying the electric wire images 11*a* thicker than the full scale thicknesses of the electric wires 11, when the electric wires 11 are laid out, the electric wire images 11*a* thereof are substantially prevented from being hidden by those electric wires 11, and so the wire laying out operation is facilitated.

The electric wire cutting control section 162 of the control device 16 is configured to control the electric wire feeding device 12 and the electric wire cutting machine 13, to perform a cutting control to cut each of those electric wires 11 to a designated length. The electric wire cutting control section 162 of the control device 16 is configured to retrieve the design value of the electric wire length of one of those electric wires 11 from the operation recipe information 172, and act to pull out the one of those electric wires 11 by a predetermined length with the transfer robot 125, and when the length of that pulled out electric wire 11 measured by the feeder becomes equal to the design value of the electric wire length in the operation recipe information 172, cut that pulled out electric wire 11 with the electric wire cutting machine 13. This results in those electric wires 11 having the lengths designated according to the design values of the electric wire lengths in the operation recipe information 172.

The printing control section 163 of the control device 16 is configured to print, with the two printers 18, the identification marks to be attached to the respective two end portions, respectively, of each of those electric wires 11. In the present embodiment, the two printers 18 are arranged on both the end portions, respectively, of the work bench 15, so as to attach the identification marks to the respective two end portions, respectively, of each of those electric wires 11. Further, in the present embodiment, the two printers 18 are used to print ring marks as the identification marks, respectively, and mark tapes with two-dimensional codes (QR codes (registered trademark)), respectively, thereon configured to be able to identify each of those electric wires 11. Note that the two code readers 19 and the two continuity checking testers 20 are also being provided so as to be able to perform the operation at the respective two ends, respectively, of each of those electric wires 11.

Figure 6:
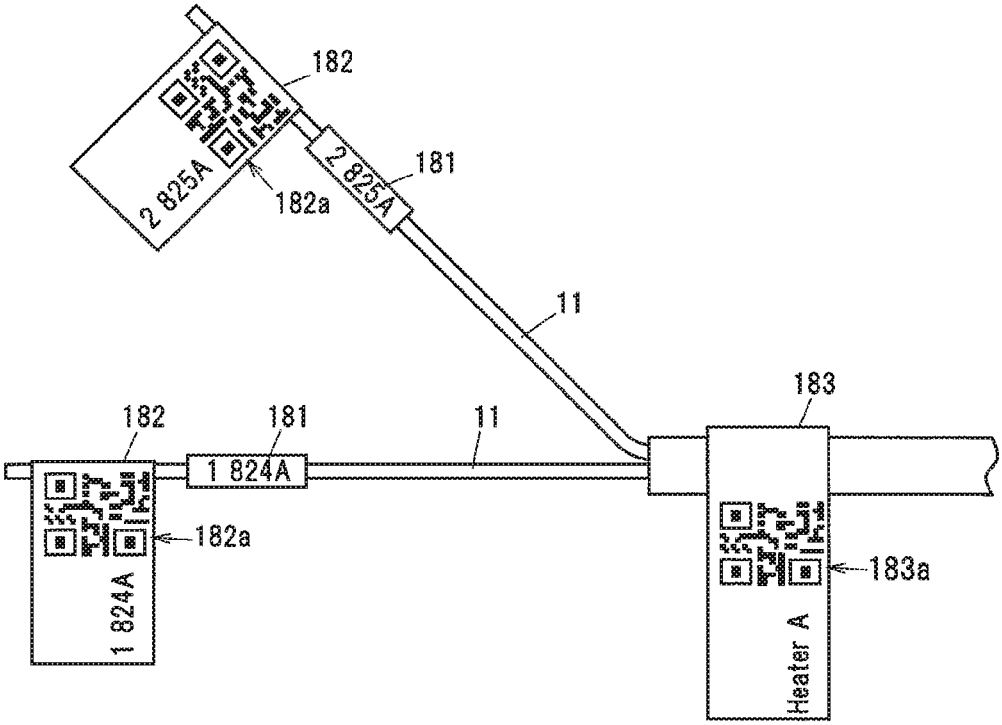
FIG. 6 is a diagram showing end portions of electric wires each being fitted with a ring mark and a mark tape thereon.

As shown in FIG. 6, the ring marks 181 and the mark tapes 182 printed by the two printers 18 are configured to be attached to the respective two end portions, respectively, of each of those electric wires 11. In the present embodiment, the mark tapes 182 are configured in such a manner that the two-dimensional codes 182*a* are printed on the mark tapes 182 respectively, but may be configured in such a manner that the bar codes are printed on the mark tapes 182 respectively. In addition, a vicinity of a branching portion of the electric wires 11 is fitted with an area label tape 183 which is configured to indicate an area (an area label in the operation recipe information 172) of a connection destination of the electric wires 11 extended out from that branching portion. As with the mark tapes 182, the area label tape 183 is configured in such a manner that a two-dimensional code 183*a* configured to be able to specify the area of the area label connection destination is printed on the area label tape 183. The mark tapes 182 and the area label tapes 183 are adhesive seals with the two-dimensional codes 182*a* and 183*aly* being printed thereon, and the mark tapes 182 and the area label tapes 183 are attached to each of the electric wires 11 in such a manner that their respective one parts are wrapped around each of the electric wires 11. The two-dimensional codes 182*a* on the mark tapes 182 are configured to be created from character information in the operation recipe information 172. Also, the two-dimensional codes 182*a* may be configured in such a manner as to include a plurality of pieces of information.

The ring marks 181 are a ring-shaped member, and are fitted on each of the end portions of the electric wires 11 by inserting each of the end portions of the electric wires 11 into an inner periphery of each of the ring marks 181 respectively. In the present embodiment, the inner diameters of the ring marks 181 are formed larger than the outer diameters of the electric wires 11, so that the ring marks 181 are movably fitted on each of the end portions of the electric wires 11 in longitudinal directions of each of the electric wires 11 respectively. Since the mark tapes 182 are located closer to the end portions of the electric wires 11 than the ring marks 181, the ring marks 181 movable in the longitudinal directions of the electric wires 11 are substantially prevented from slipping off the end portions of the electric wires 11 respectively.

Note that, in the present embodiment, the ring marks 181 and the mark tapes 182 are used as the identification marks, but that the ring marks 181 may be omitted while only the mark tapes 182 may be used as the identification marks. Further, it is naturally possible to use an IC tag, an RFID tag, or the like as the identification marks. Further, the information to be printed on the mark tapes 182, the ring marks 181, and the area label tapes 183 may be printed on an outer periphery of each of the electric wires 11 (on an outer periphery of the outer sheath of each of the electric wires 11).

The continuity checking section 164 of the control device 16 is configured to check the continuity of each of the electric wires 11 after laying out of each of the electric wires 11. The continuity checking section 164 of the control device 16 is configured to perform the continuity checking by bringing the probes of the two continuity checking testers 20 into contact with the conductor of each of the electric wires 11 at both the end portions of each of the electric wires 11 to obtain the conductor resistance of each of the electric wires 11, and make a decision as to whether the conductor resistance of each of the electric wires 11 is within a predetermined normal range. In the present embodiment, the continuity checking section 164 of the control device 16 is configured in such a manner as to display an indication of the continuity checking on the plurality of display devices 14 of the work bench 15 by means of the displaying control section 161 of the control device 16 after the laying out of each of the electric wires 11, and to erase the display of the indication of the continuity checking after continuity checking of each of the electric wires 11.

Further, the control device 16 is configured to include a time recording section 165, which is configured to store a time at which the two bar codes 146 displayed on the plurality of display devices 14 have been read in by the two code readers 19, in the storing section 17 of the control device 16 as progress administration information 173. The progress administration information 173 is transmitted to an administration server 21, which will be described later, and is used in the administration of the progress information.

Further, the control device 16 is configured to include a correspondence decision section 166 that is configured to make a decision as to whether the code information in the identification marks (the two-dimensional codes 182*a* on the mark tapes 182) read in by the two code readers 19, and the code information in the identification codes (the bar codes 146) displayed on the plurality of display devices 14 are in correspondence with each other. In the present embodiment, the code information in the two-dimensional codes 182*a* on the mark tapes 182 and the code information in the bar codes 146 displayed on the plurality of display devices 14 are configured to match each other, and the correspondence decision section 166 of the control device 16 is configured to make a decision as to whether the code information in the two-dimensional codes 182*a* on the mark tapes 182 read in by the two code readers 19, and the code information in the bar codes 146 displayed on the plurality of display devices 14 are matching each other.

The correspondence decision section 166 of the control device 16 is configured in such a manner that, as a result of the decision made by the correspondence decision section 166, if the code information in the two-dimensional codes 182*a* on the mark tapes 182 read in by the two code readers 19, and the code information in the bar codes 146 displayed on the plurality of display devices 14 are not matching each other, then the correspondence decision section 166 displays alert information on the plurality of display devices 14 by means of the displaying control section 161 of the control device 16. Note that the correspondence decision section 166 of the control device 16 may be configured in such a manner that, for example when the code information in the two-dimensional codes 182*a* on the mark tapes 182 read in by the two code readers 19, and the code information in the bar codes 146 displayed on the plurality of display devices 14 are not matching each other, the correspondence decision section 166 activates an alarm device configured to generate an alarm with sound or light or the like, and provided adjacent to the work bench 15.

The time recording section 165 of the control device 16 is equipped with a built-in clock function, and is configured to, each time one of the plurality of electric wires 11 is laid out, store a time at which the one of the plurality of electric wires 11 has been laid out, in the storing section 17 of the control device 16. In the present embodiment, the time recording section 165 of the control device 16 is configured to store a time at which the identification codes (the bar codes 146) have been read in by the two code readers 19, in the storing section 17 of the control device 16. The time recording section 165 of the control device 16 is configured in such a manner that, as a result of the decision made by the correspondence decision section 166 of the control device 16, when the correspondence decision section 166 has determined that the code information in the two-dimensional codes 182*a* on the mark tapes 182 read in by the two code readers 19, and the code information in the bar codes 146 displayed on the plurality of display devices 14 are matching each other, the time recording section 165 stores a time at which the bar codes 146 have been read in, in the storing section 17 of the control device 16 as the progress administration information 173.

Note that the time at which the identification codes have been read in is not limited to the foregoing, but that the time at which the correspondence decision section 166 of the control device 16 has determined that the code information in the two-dimensional codes 182*a* on the mark tapes 182 read in by the two code readers 19, and the code information in the bar codes 146 displayed on the plurality of display devices 14 are matching each other may be stored as the time at which the identification codes have been read in. That is, the "time at which the identification codes have been read in" may not be strictly the time at which the identification codes have been read in, but the time at which the predetermined decision processing or the like resulting from the identification codes having been read in (in the present embodiment, the processing which determines that the code information in the two-dimensional codes 182*a* on the mark tapes 182 read in by the two code readers 19, and the code information in the bar codes 146 displayed on the plurality of display devices 14 are matching each other) has ended, may be stored as the "time at which the identification codes have been read in".

Further, the wire harness producing device 10 is configured to include an administration server 21, which is provided in such a manner as to be able to communicate with the control device 16. Only one control device 16 is shown in FIG. 1, but in practice, on each of production lines (the respective work bench 15 of each of the production lines), the respective control device 16 thereof is provided, and the administration server 21 is provided in such a manner as to be able to communicate with the respective control device 16 of each of the production lines.

The administration server 21 is configured to perform the creation of the wire laying out image data and the administration of the progress information, and is configured as an appropriate combination of a computing element, a memory, an interface, a hard disk, a software and the like. The administration server 21 is configured to include a two-dimensional image creating section 211, a compartmentalizing section 212, a wire laying out image data creating section 213, and a progress status administrating section 214.

Figure 7A:
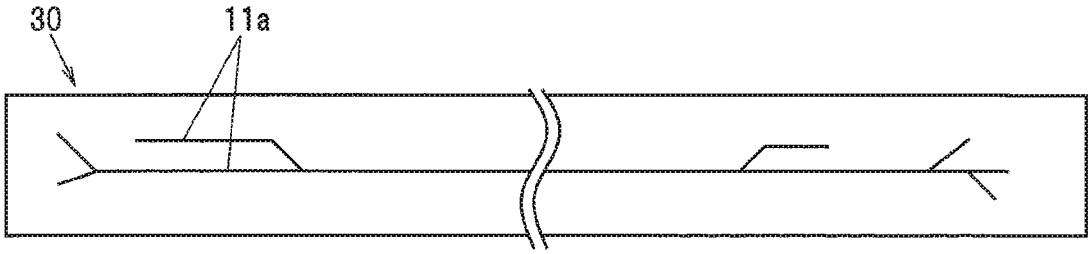
FIG. 7A is a diagram showing one example of a two-dimensional image of a wire harness.

The two-dimensional image creating section 211 of the administration server 21 is configured to create a two-dimensional image of the entire wire harness on the basis of three-dimensional data (CAD data) 221 of the wire harness stored in a storage section 22 of the administration server 21. The procedure for creating the two-dimensional image from the three-dimensional data 221 is not particularly limited, but the two-dimensional image can be created from the three-dimensional data 221 by performing, for example, such a processing as to convert the coordinate positions of each point in the three-dimensional data 221 into coordinates projected on a two-dimensional plane. FIG. 7A shows one example of the two-dimensional image 30 created by the two-dimensional image creating section 211 of the administration server 21.

Note that the two-dimensional image creating section 211 of the administration server 21 is not limited to the foregoing, but may be configured in such a manner as to create the two-dimensional image 30 from the three-dimensional data 221 via two-dimensional data. Alternatively, the two-dimensional image creating section 211 may be configured in such a manner as to create the two-dimensional image 30 by, for example, using two-dimensional data such as a design drawing or the like and performing size adjustment or trimming. Alternatively, the two-dimensional image creating section 211 may be configured in such a manner as to create the two-dimensional image 30 on the basis of the coordinate information on the branching positions of the electric wires 11 and the coordinate information on the end portions of the electric wires 11 included in the operation recipe information 172. Alternatively, the two-dimensional image 30 may be pre-created with an external device or the like, and the two-dimensional image 30 may be imported into the administration server 21 from that external device or the like. In this case, the two-dimensional image creating section 211 of the administration server 21 can be omitted.

Figure 7B:
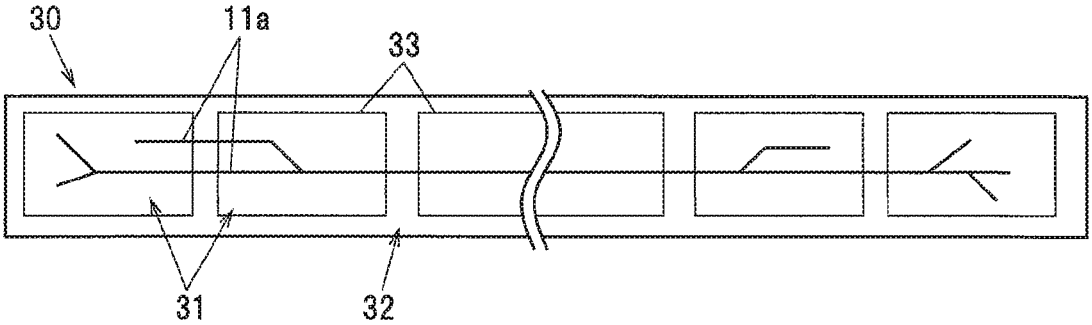
FIG. 7B is a diagram showing one example of the two-dimensional image with compartmentalizing lines added to the two-dimensional image shown in FIG. 7A.

The compartmentalizing section 212 of the administration server 21 is configured to compartmentalize the two-dimensional image 30 into display regions 31 to be displayed on the respective display portions 141 of the plurality of display devices 14 respectively and non-display regions 32 corresponding to the respective bezel portions 142 of the plurality of display devices 14 respectively, with the display regions 31 and the non-display regions 32 conforming to preset sizes of the respective display portions 141 and the respective bezel portions 142, respectively, of the plurality of display devices 14. As shown in FIG. 7B, the compartmentalizing section 212 of the administration server 21 is configured to add compartmentalizing lines 33 configured to compartmentalize the two-dimensional image 30 into the display regions 31 and the non-display regions 32 to the two-dimensional image 30. Note that the compartmentalizing section 212 of the administration server 21 may not actually create the two-dimensional image 30 with the compartmentalizing lines 33 added thereto, but that the compartmentalizing lines 33 may be virtual (that is, the compartmentalizing section 212 of the administration server 21 may perform only such a processing as to determine the coordinates of the compartmentalizing lines 33 or the like).

The compartmentalizing section 212 of the administration server 21 is configured to compartmentalize the two-dimensional image 30 into the display regions 31 and the non-display regions 32 in such a manner that a portion that serves as a marker for the operator to perform the wire laying out during the wire laying out, specifically, the end portions (ranges of predetermined lengths from the end portions) of the electric wires 11 (the electric wire images 11*a*) in the two-dimensional image 30, and the branching portions of the electric wires 11 (the electric wire images 11*a*) in the two-dimensional image 30 are not included in the non-display regions 32. For example, the coordinates of the end portions and the branching portions of the electric wires 11 are extracted, and the compartmentalizing lines 33 are set in the two-dimensional image 30 in such a manner that those coordinates are not included in the non-display regions 32. Note that the compartmentalizing section 212 of the administration server 21 may be configured in such a manner that, for example, the operator checks the two-dimensional image 30 with the compartmentalizing lines 33 having been created by that compartmentalizing section 212 and added thereto, and when the end portions or the branching portions of the electric wires 11 in the two-dimensional image 30 is included in the non-display regions 32, the operator can make fine adjustments of the positions of the compartmentalizing lines 33 by hand work. In this manner, the end portions and the branching portions of the electric wires 11 in the two-dimensional image 30 are arranged in such a manner as to be not included in the non-display regions 32.

Figure 7C:
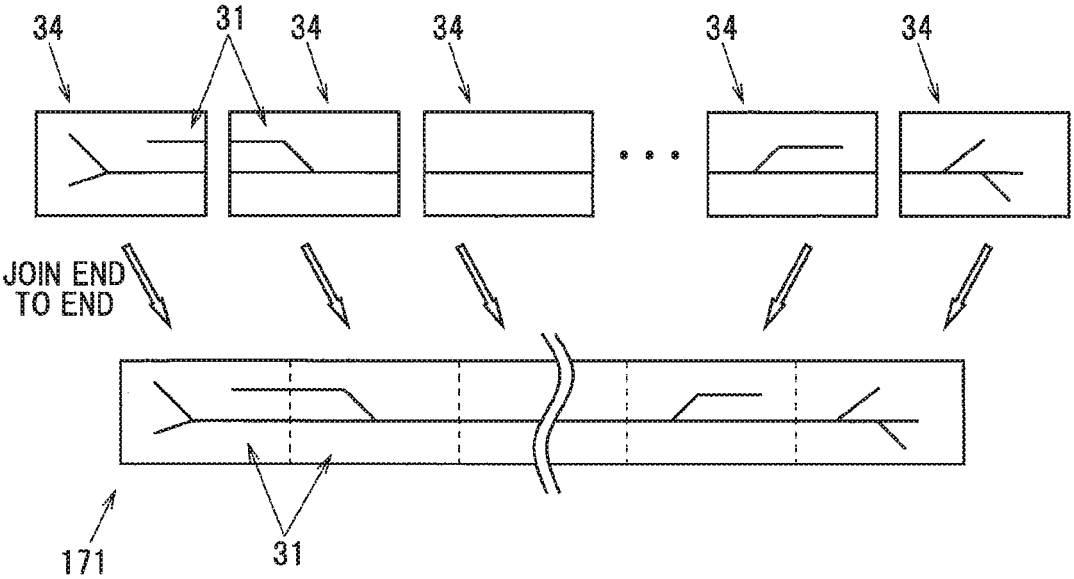
FIG. 7C is a diagram showing a procedure for creating wire laying out image data and one example of the wire laying out image data.

The wire laying out image data creating section 213 of the administration server 21 is configured to trim the two-dimensional image 30 at the positions of the compartmentalizing lines 33 to create image data composed of only the display regions 31 for the wire laying out drawing 143, in other words, the wire laying out image data 171. Specifically, as shown in FIG. 7C, the wire laying out image data creating section 213 of the administration server 21 is configured to create a plurality of image data 34, which are produced by extracting only the portions in the display regions 31 surrounded by the compartmentalizing lines 33 from the two-dimensional image 30, and join the plurality of created image data 34 in the plurality of display regions 31 end to end, to thereby create the image data excluding the non-display regions 32, in other words, the wire laying out image data 171. The wire laying out image data creating section 213 of the administration server 21 is configured to store the created wire laying out image data 171 in the storage section 22 of the administration server 21. Note that, in order to reduce the burden on the eyes, a background of the wire laying out image data 171 created by the wire laying out image data creating section 213 of the administration server 21 may not be white. It should be noted, however, that, if the color of the background is the same as the colors of the electric wires 11 (the colors of the outermost layers of the electric wires 11), it may be difficult to perform the wire laying out operation, so it is desirable that the background color be made different from the colors of the electric wires 11.

The storage section 22 of the administration server 21 is configured to store the wire laying out image data 171 and the operation recipe information 172 of all types of the wire harnesses to be produced within a factory. The administration server 21 is configured to transmit to the respective control device 16 of each one of the production lines the wire laying out image data 171 and the operation recipe information 172 of the wire harnesses allocated to that one of the production lines.

The respective control device 16 of each one of the production lines is mounted with a graphics card 167 thereon, and the displaying control section 161 of the control device 16 transmits the wire laying out image data 171 to each of the respective plurality of display devices 14 of that one of the production lines by means of that graphics card 167. Herein, for that graphics card 167, the two 6-channel graphics cards 167 are used in the control device 16. The two 6-channel graphics cards 167 being mounted on the control device 16 are configured in such a manner that the outputs of the two 6-channel graphics cards 167 are sent to two of the display devices 14 each by means of separators 168, respectively. This allows the 12 outputs of the two 6-channel graphics cards 167 to branch into two each and the resulting 24 outputs to be connected to the 24 display devices 14, respectively. In a typical personal computer, the number of the graphics cards 167 to be able to be mounted thereon, that is, the number of the channels to be able to be output from the graphics cards 167 is limited, but the use of the separators 168 in conjunction with the graphics cards 167 allows the use of many more display devices 14. In the present embodiment, an HDMI (High-Definition Multimedia Interface) cable is used as cables for connecting the graphics cards 167 and the separators 168 and cables for connecting the separators 168 and the plurality of display devices 14, but another display cable, such as a DVI (Digital Visual Interface) cable or a DP (DisplayPort) cable, or the like may be used as the cables for connecting the graphics cards 167 and the separators 168 and the cables for connecting the separators 168 and the plurality of display devices 14.

In order to reduce the lengths of the cables to be used, it is desirable that the separators 168 being used in conjunction with the graphics cards 167 being mounted on the respective control device 16 of each one of the production lines are arranged as close to the respective plurality of display devices 14 of that one of the production lines as possible. In the present embodiment, the lengths of the cables connecting the graphics cards 167 and the separators 168 are made longer than the lengths of the cables connecting the separators 168 and the plurality of display devices 14.

By multistage branching and connection of the cables with the graphics cards 167 and the separators 168, the cables between the graphics cards 167 and the separators 168 can be united, so it is possible to reduce the total quantity of the cables used and thereby ensure a lowering in cost, and it is also possible to reduce the wiring space for the cables. As in the present embodiment, by making the lengths of the cables connecting the graphics cards 167 and the separators 168 longer than the lengths of the cables connecting the separators 168 and the plurality of display devices 14, it is possible to further reduce the total quantity of the cables used, and it is also possible to further reduce the wiring space for the cables.

Figure 8:
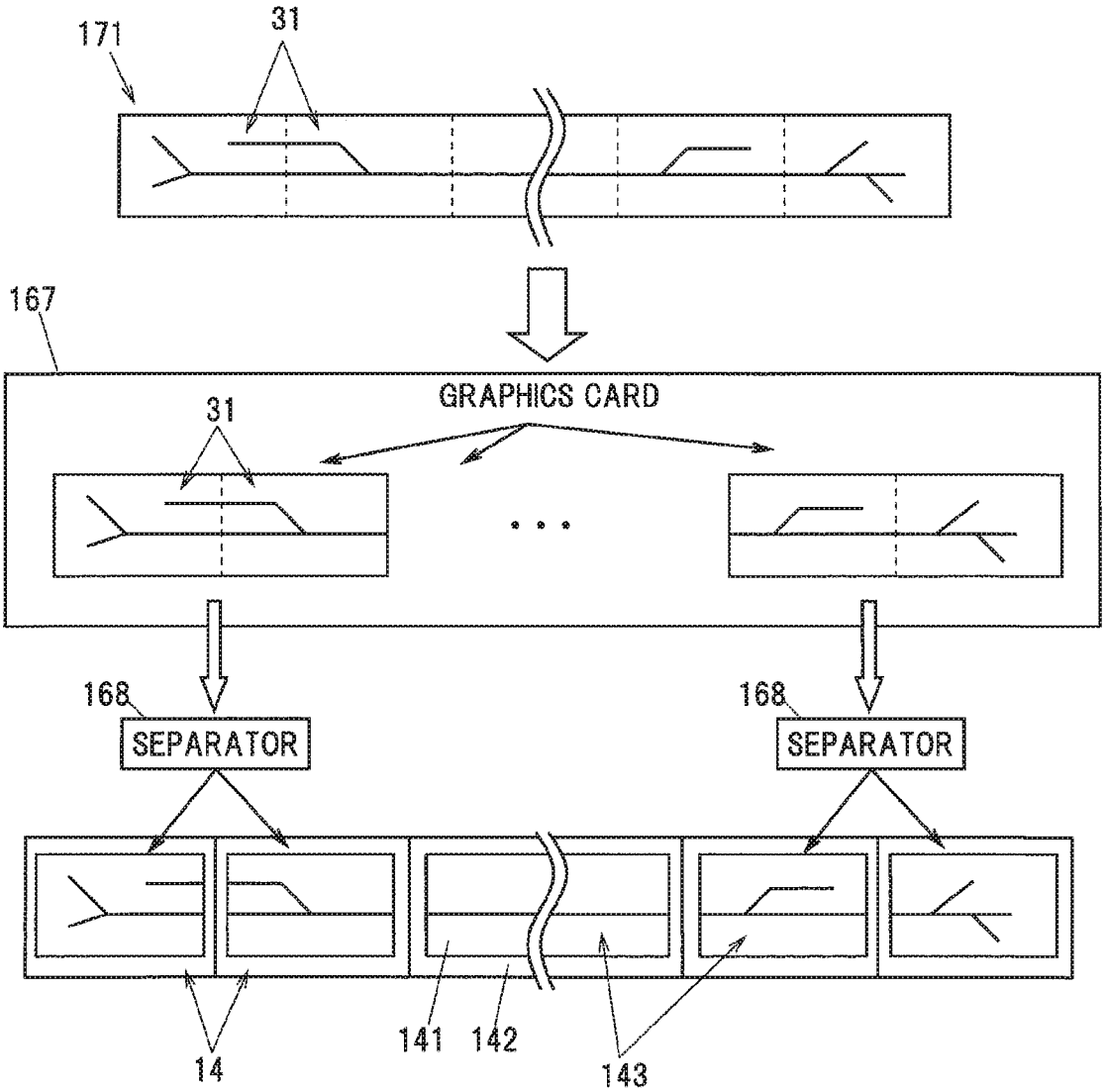
FIG. 8 is a diagram for explaining a mechanism for displaying a wire laying out drawing on each of the display devices.

As shown in FIG. 8, the wire laying out image data 171 output from the displaying control section 161 is separated by the graphics cards 167 into every two of the display devices 14 (every two of the image data 34 described above), and the separated image data 171 are further separated into two each by the separators 168 and displayed on the respective display portion 141 of each of the plurality of display devices 14. As a result, the full scale wire laying out drawing 143, allowing for the sizes of the respective display portions 141 and the respective bezel portions 142 of the plurality of display devices 14, is displayed on the plurality of display devices 14.

In the present embodiment, the work bench 15 is constituted by arranging the plurality of display devices 14 end to end in one row, but one end portion in the direction of the arrangement of the plurality of display devices being arranged end to end in one row is set as a reference end portion which serves as a reference during wire laying out. In the example of the plurality of display devices being arranged end to end in one row shown in FIG. 1, the left end portion thereof shown, adjacent to which the electric wire feeding device 12 and the electric wire cutting machine 13 are arranged is set as the reference end portion. In FIG. 1, for simplicity of the illustration, the control device 16 is shown in a substantially middle portion of the work bench 15, but in practice, the control device 16 is also being arranged adjacent to the reference end portion.

As shown in FIGS. 1 and 5A, the display device 14 being arranged closest to the reference end portion is configured to display a production information screen 143*a* with production information including the information on the wire harnesses to be produced, the information on the operator, the production procedure, and the like, to be displayed on that production information screen 143*a*, but with no images of the wire harnesses to be displayed on that production information screen 143*a*. The production information screen 143*a* may be configured as a part of the wire laying out image data 171 or may be configured in such a manner as to be created separately from the wire laying out image data 171. In the present embodiment, the production information screen 143*a* is configured as image data and is configured as a part of the wire laying out image data 171. Note that the production information screen 143*a* may be configured in such a manner as to be preadded to the two-dimensional image 30, or may be configured in such a manner as to be pre-created separately from the two-dimensional image 30, and added to the wire laying out image data 171 when the wire laying out image data 171 is created by the wire laying out image data creating section 213 of the administration server 21.

Furthermore, the displaying control section 161 of the control device 16 may be configured in such a manner that, if there are one or more of the plurality of display devices 14 with no wire laying out drawing 143 being displayed thereon, the displaying control section 161 of the control device 16 allows the one or more of the plurality of display devices 14 with no wire laying out drawing 143 being displayed thereon to switch to a sleep mode or a power saving mode, or to power off. Note that the sleep mode refers to a mode which turns only the display of the display device 14 off and the display device 14 to a standby state, and that the power saving mode refers to a mode which ensures a reduction in power consumption by lowering or the like of the brightness of the display of the display device 14. Note that the function of setting the plurality of display devices 14 to the sleep mode or the power saving mode may be equipped in the plurality of display devices 14. In this case, each of the plurality of display devices 14 may be configured in such a manner as to be transitioned to the sleep mode or the power saving mode, for example, when no display data has been input thereto for a specified period of time, or when image data consisting of only the background has been input thereto. Whether or not the image data is the image data consisting of only the background, that is, whether or not the received image data includes the image of the wire harness therein can be determined in accordance with, for example, a volume of the received image data or the like.

Figure 9:
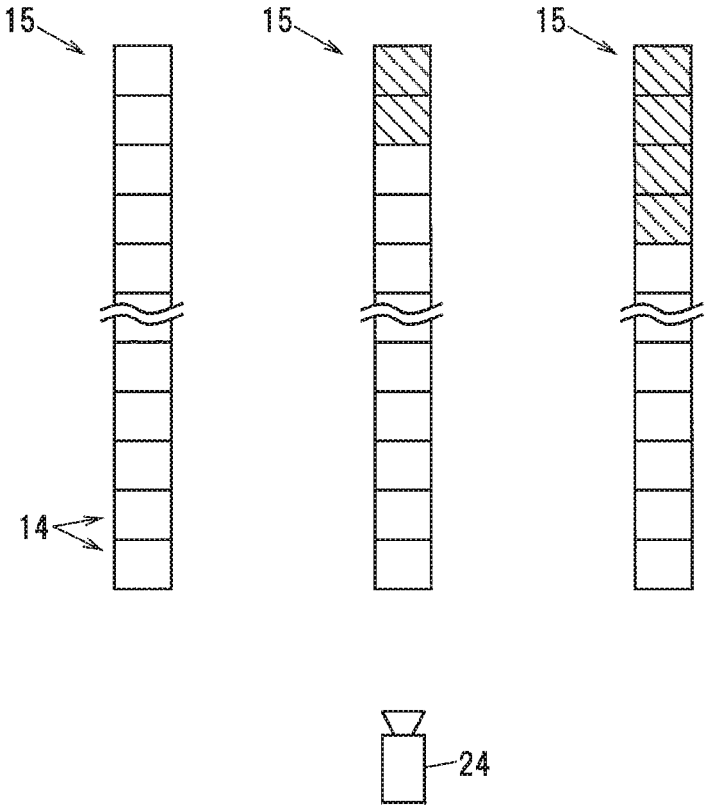

By configuring the plurality of display devices 14 in the foregoing manner, the power consumption of the one or more of the plurality of display devices 14 being not used in the wire laying out is suppressed, thereby being able to reduce the power consumption of the entire system. Further, as shown in FIG. 9, by recording an image of the respective work bench 15 of each of the production lines with an image recording device 24 such as a monitoring camera or the like in the factory, it is possible to easily check what length of the wire harness is currently being produced on the work bench 15, which results in a contribution to making the factory administrating operation efficient. Note that, in FIG. 9, the display devices 14 being placed in the sleep mode or the power saving mode or being powered off are indicated by hatching.

Figure 10:
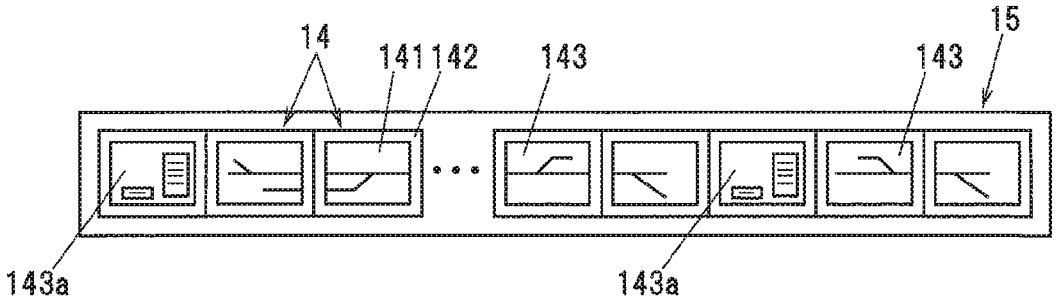
FIG. 10 is a diagram showing a display example on the display devices when two wire harnesses are displayed on the work bench.

Further, the displaying control section 161 of the control device 16 may be configured in such a manner as to be able to display a plurality of the wire harnesses having lengths on the plurality of display devices 14 arranged end to end in one row, in accordance with the lengths of the plurality of the wire harnesses to be laid out. For example, as shown in FIG. 10, two of the wire harnesses may be displayed on one work bench 15. Note that it is naturally possible to display three or more of the wire harnesses on one work bench 15. This makes it possible to use the production space of the factory efficiently.

Further, when the plurality of the wire harnesses are displayed on one work bench 15, the respective production information screen 143*a* of each of the plurality of the wire harnesses is displayed on the respective display device 14 arranged closest to the respective reference end portion of each plurality of the display devices 14 configured to display each of the plurality of the wire harnesses. As a result, the respective production information screen 143*a* of each of the plurality of the wire harnesses becomes present between adjacent ones of the respective images of the plurality of the wire harnesses, and the work space for the wire laying out of each of the plurality of the wire harnesses is thus compartmentalized by the respective production information screen 143*a* of each of the plurality of the wire harnesses, thereby making it possible to suppress the occurrence of a failure such as a collision between operators performing the wire laying out work of each of the plurality of the wire harnesses during the working. Note that, for example, when the respective images of two of the wire harnesses are displayed on one work bench 15, the image of one of the wire harnesses may be displayed thereon by being moved to the reference end portion side of one plurality of the display devices 14 while the image of the other one of the wire harnesses may be displayed thereon by being moved to the opposite side to the reference end portion of the other plurality of the display devices 14. This makes the work regions for both the wire harnesses further away from each other, and therefore makes the wire laying out work of the operators easier.

The progress status administrating section 214 of the administration server 21 is configured to act to retrieve the time at which the identification codes have been read in, in other words, the progress administration information 173, having been stored in the storage section 17 of the control device 16, and store that retrieved progress administration information 173 in the storage section 22 of the administration server 21, while acting to obtain a progress status of the production of the wire harness on the basis of that retrieved progress administration information 173, and display that obtained progress status on an administration display 23. In the present embodiment, a monitor attached to the administration server 21 is used as the administration display 23, but a monitor provided separately from the administration server 21, such as a large-screen monitor provided in the factory or the like, may be used as the administration display 23.

More specifically, the progress status administrating section 214 of the administration server 21 is configured to, on the basis of the progress administration information 173, obtain the number of the laid out electric wires 11, the number of the unlaid out electric wires 11, the proportion of the number of the laid out electric wires 11 to the total number of the electric wires 11 to be laid out, a preset standard operating time (target operating time), an elapsed time from the start of the operation, and the like on each of the production lines, and display them on the administration display 23 as a progress status display screen.

Figure 11:
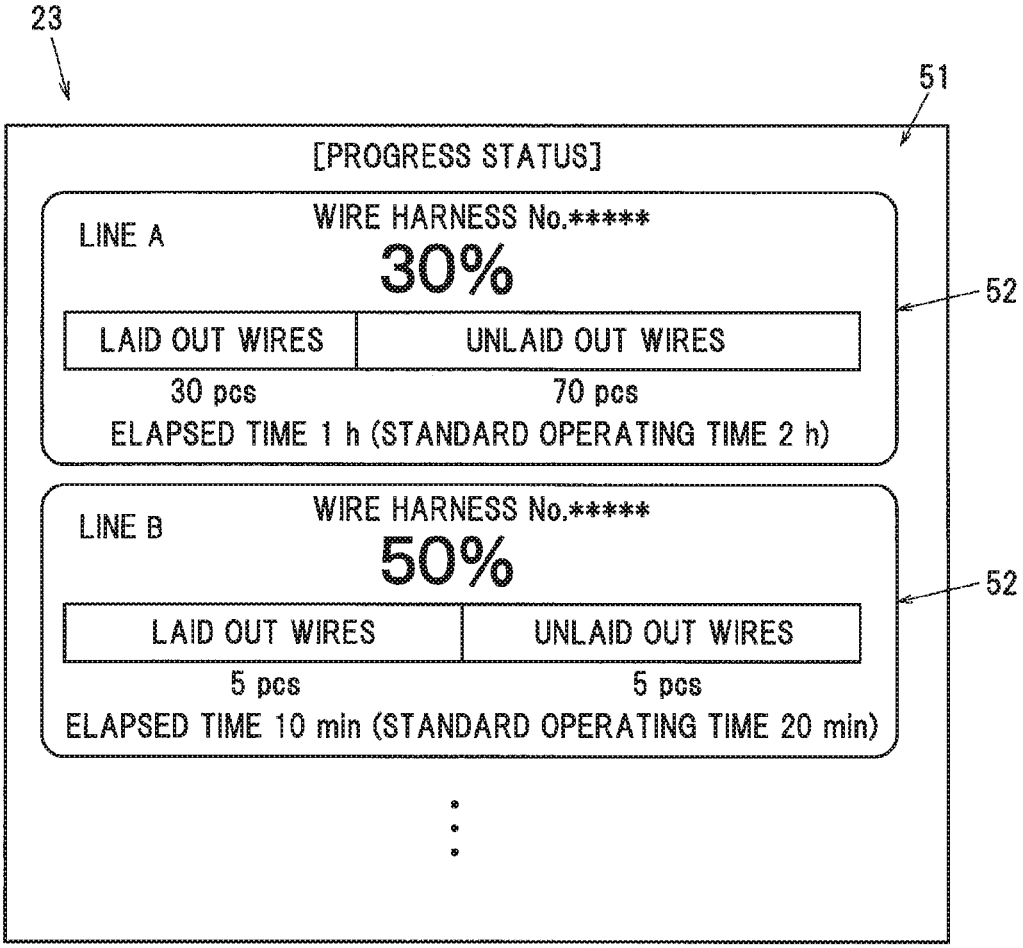
FIG. 11 is a diagram showing one example of a progress status display screen.

FIG. 11 shows one example of the progress status display screen 51. As shown in FIG. 11, the progress status display screen 51 is configured in such a manner as to display the respective progress status of each of the production lines of the factory, for example. Herein, as one example, a case is shown in which respective individual progress status displaying sections 52 of the two production lines A and B are displayed, but the number of the production lines to be displayed is not limited to the above number. Also, for the display form of each of the individual progress status displaying sections 52, various display forms can be adopted, for example by using a bar graph or a pie chart or the like to display the progress statuses. The respective display contents of each of the individual progress status displaying sections 52 are also not limited to those shown in FIG. 11, but can appropriately be configured, for example by displaying the proportion of the elapsed time to the standard operating time (target operating time), or the like.

(Wire Harness Producing Method)

Figure 12A:
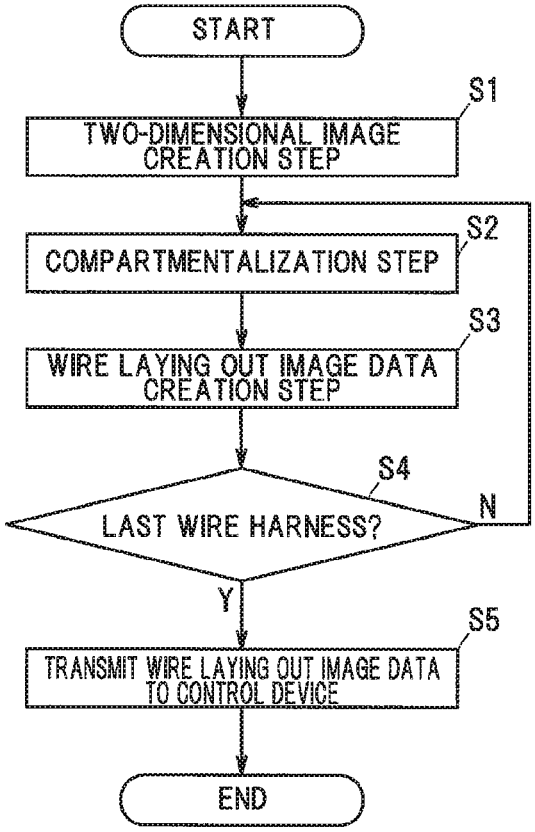
FIG. 12A is a flow chart for creating the wire laying out image data.

In a wire harness producing method according to the present embodiment, first, in the administration server 21, the wire laying out image data 171 on all wire harnesses to be produced are created. FIG. 12A is a flow chart showing a procedure for creating the wire laying out image data 171.

As shown in FIG. 12A, first, in step S1, a two-dimensional image creation step is performed. In the two-dimensional image creation step, the two-dimensional image creating section 211 of the administration server 21 creates the two-dimensional image 30 of an entire wire harness by using the three-dimensional data 221 prestored in the storage section 22 of the administration server 21. Note that, as described above, the two-dimensional image creating section 211 of the administration server 21 may be configured in such a manner as to create the two-dimensional image 30 from the three-dimensional data 221 via two-dimensional data, or may be configured in such a manner as to create the two-dimensional image 30 from two-dimensional data such as a design drawing or the like.

After that, in step S2, a compartmentalization step is performed. In the compartmentalization step, the compartmentalizing section 212 of the administration server 21 compartmentalizes the created two-dimensional image 30 of the entire wire harness into the display regions 31 to be displayed on the respective display portions 141 of the plurality of display devices 14 respectively and the non-display regions 32 corresponding to the respective bezel portions 142 of the plurality of display devices 14 respectively, with the display regions 31 and the non-display regions 32 conforming to the sizes of the respective display portions 141 and the respective bezel portions 142, respectively, of the plurality of display devices 14. Note that, in the compartmentalization step, the compartmentalization of the two-dimensional image 30 into the display regions 31 and the non-display regions 32 is performed in such a manner that the end portions and the branching portions of the electric wires 11 in the two-dimensional image 30 are not included in the non-display regions 32.

After that, in step S3, a wire laying out image data creation step is performed. In the wire laying out image data creation step, the wire laying out image data creating section 213 of the administration server 21 trims the compartmentalized two-dimensional image 30 to create the image data composed of only the display regions 31 for the wire laying out drawing 143, in other words, the wire laying out image data 171, and stores that created wire laying out image data 171 in the storage section 22 of the administration server 21. Note that, although not shown in FIG. 12A, at this point of time, the operation recipe information 172 is stored in the storage section 22 of the administration server 21 in such a manner as to correspond to the wire laying out image data 171.

After that, in step S4, a decision is made as to whether the wire harness whose wire laying out image data 171 has been created is the last wire harness of the wire harnesses to be produced. If a No decision is made in step S4, then the flow returns to step S1, followed by performing the creation of the wire laying out image data 171 on the next wire harness.

Figure 12B:
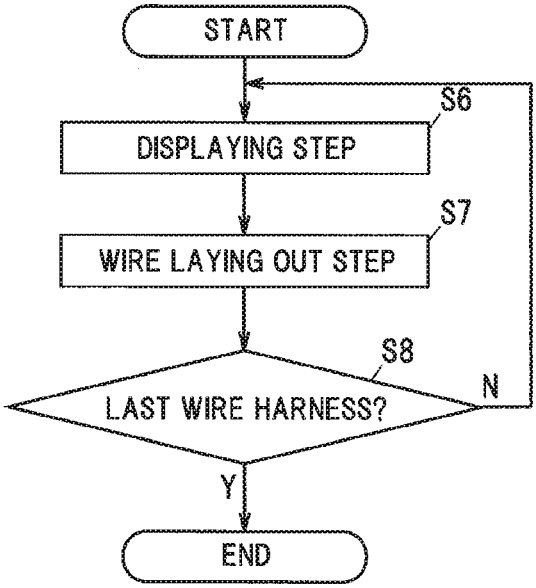
FIG. 12B is a flow chart for producing the wire harness using the created wire laying out image data.

If a Yes decision is made in step S4, then, in step S5, the wire laying out image data 171 and the work recipe information 172 of the wire harnesses to be produced on each one of the production lines are transmitted to the respective control device 16 of that one of the production lines, in accordance with a preset allocation. After that, the processing is ended. Note that step S5 may be performed before making the decision in step S4. Although in FIGS. 12A and 12B is shown a case in which the wire laying out image data 171 of a plurality of the wire harnesses are created, only one wire laying out image data 171 may be created, and in this case, step S4 can be omitted.

After the wire laying out image data 171 have been created, in the respective control device 16 of each one of the production lines, the wire harnesses are produced by using the respective created wire laying out image data 171 thereof. FIG. 12B is a flow chart showing a procedure for producing the wire harnesses at this point of time. As shown in FIG. 12B, first, in step S6, a wire laying out drawing displaying step is performed. In the wire laying out drawing displaying step, the displaying control section 161 of the respective control device 16 of that one of the production lines displays the wire laying out drawing 143 of the wire harness to be first produced on each of the plurality of displays 14 on the basis of the wire laying out image data 171 of that wire harness to be first produced having been received from the administration server 21 and stored in the storage section 17 of the control device 16. At this point of time, if there are one or more of the plurality of display devices 14 with no wire laying out drawing 143 being displayed thereon, the one or more of the plurality of display devices 14 with no wire laying out drawing 143 being displayed thereon are placed in the sleep mode or the power saving mode or powered off. Also, the display device 14 being arranged closest to the reference end portion displays the production information screen 143*a*.

After that, in step S7, a wire laying out step is performed. The wire laying out step will be described later. When the wire laying out step is finished, in step S8, a decision is made as to whether the wire harness having been laid out is the wire harness to be last produced on that one of the production lines. If a No decision is made in step S8, then the flow returns to step S6 to perform the production of the next wire harness. If a Yes decision is made in step S8, then the production of the wire harnesses is ended.

Figure 13:
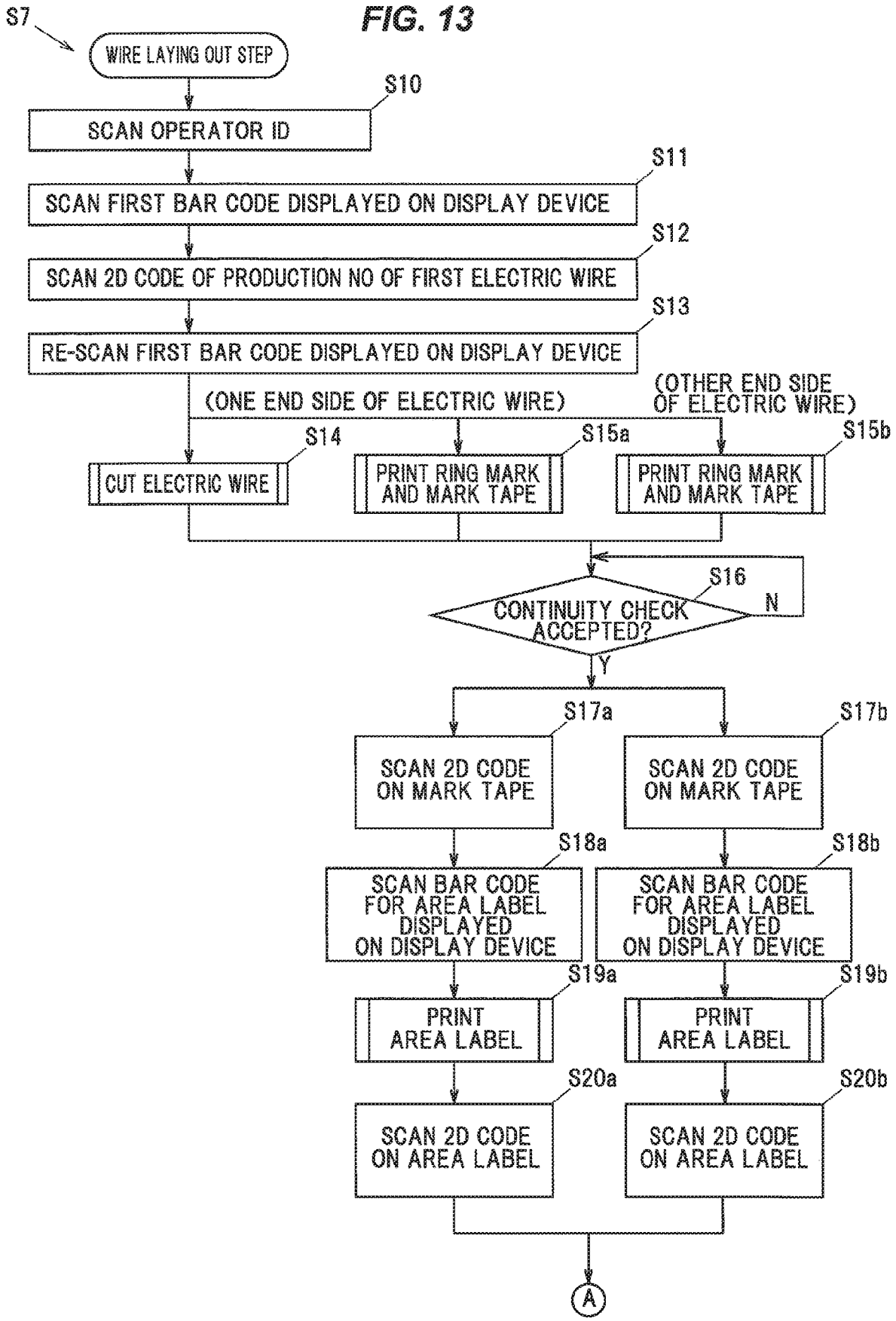
FIG. 13 is a flow chart showing a procedure of a wire laying out step.
Figure 14:
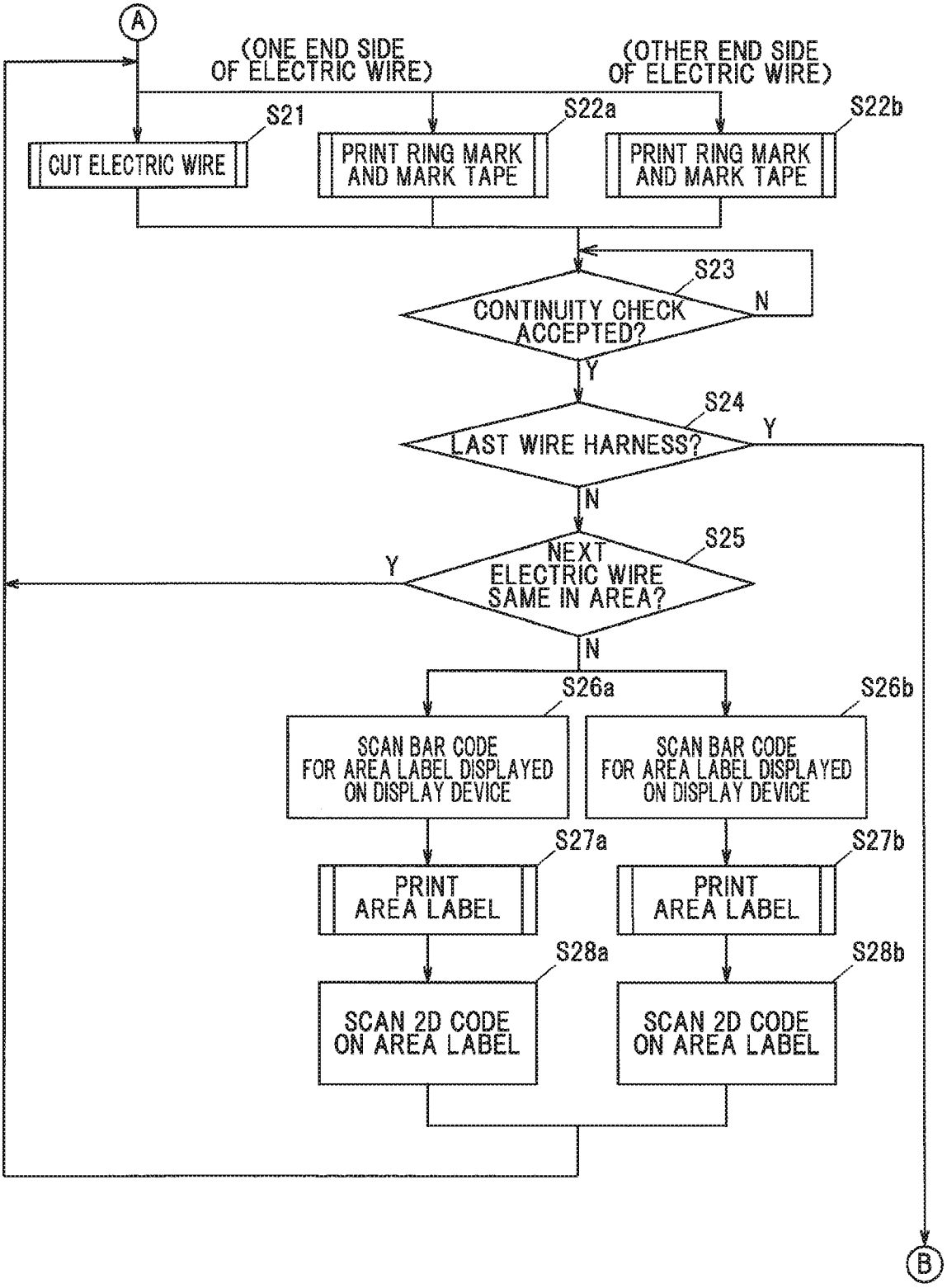
FIG. 14 is a flow chart showing a procedure of the wire laying out step.
Figure 15:
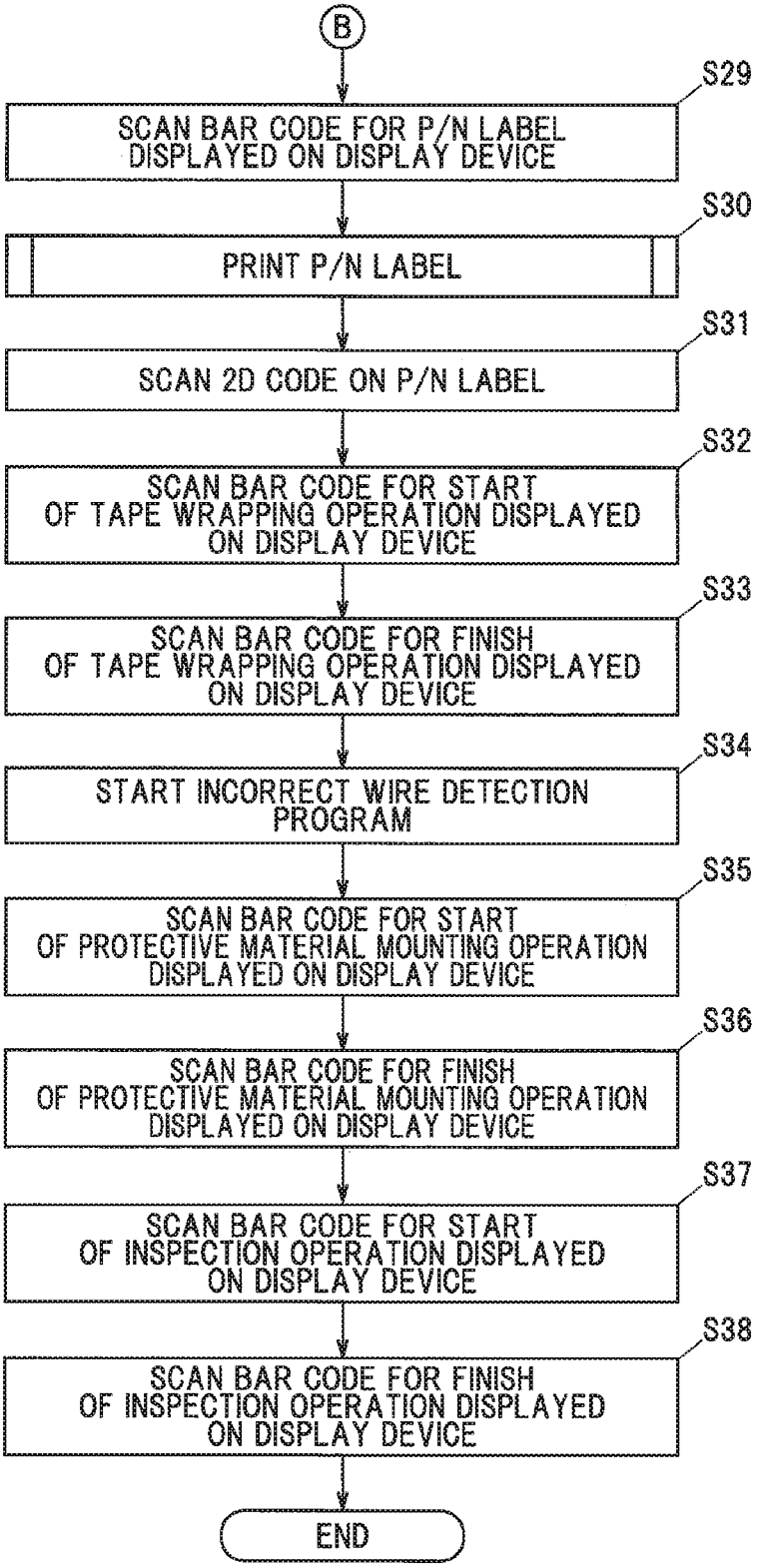
FIG. 15 is a flow chart showing a procedure of the wire laying out step.

FIGS. 13 to 15 are flow charts showing a procedure for the wire laying out step in step S7. As shown in FIGS. 13 to 15, in the wire laying out step, first, in step S10, operators IDs are scanned with the two code readers 19, respectively. The operators IDs each refer to a code allocated to each one of the operators to identify that one of the operators, and are each being displayed on, for example a name tag or the like as a bar code. The information on the scanned operators IDs are stored in the storage section 17 of the respective control device 16 of that one of the production lines. At this point of time, the displaying control section 161 of the control device 16 may be configured in such a manner as to display an indication of reading in the operators IDs on the respective plurality of display devices 14 of that one of the production lines. When the operators IDs are scanned, the displaying control section 161 of the control device 16 displays the two bar codes 146 of the electric wire 11 to be first laid out on the plurality of display devices 14. The two bar codes 146 are displayed adjacent to both the end portions, respectively, of that electric wire 11 to be laid out.

After that, in step S11, the operators scan the first bar codes 146 displayed on the plurality of display devices 14. After that, in step S12, the two-dimensional code of the production number of that electric wire 11 to be first laid out is scanned. Specifically, the electric wire identification code attached to the reel 121 is read in with the two code readers 19. The displaying control section 161 of the control device 16 may be configured in such a manner that, at this point of time, if the production number of that electric wire 11 included in the information in the electric wire identification code is not matching the production number of that electric wire 11 in the operation recipe information 172, then that displaying control section 161 displays a reel replacement indication on the plurality of display devices 14, for example.

After that, in step S13, when the first bar codes 146 displayed on the plurality of display devices 14 are scanned again, in step S14, the electric wire cutting control section 162 of the control device 16 controls the electric wire feeding device 12 and the electric wire cutting machine 13, and cuts the nth electric wire 11 to the electric wire length set in the operation recipe information 172. In addition, in parallel with step S14, in steps S15*a* and S15*b*, the ring marks 181 and the mark tapes 182 are printed with the two printers 18 at both one end side and the other end side of that electric wire 11. The operators use, as markers, the wire laying out image data 171 and the bar codes 146 displayed on the plurality of display devices 14, and arrange that cut electric wire 11 while attaching the ring marks 181 and the mark tapes 182 to both the end portions of that electric wire 11.

After that, in step S16, a continuity checking is performed. The operators bring the probes of the two continuity checking testers 20 into contact with the conductor of that electric wire 11 at both the end portions, respectively, of that electric wire 11. The continuity checking section 164 of the control device 16 computes the electric conductivity of that electric wire 11 on the basis of the outputs of the two continuity checking testers 20, and if the computed electric conductivity of that electric wire 11 falls within a predetermined normal value range, then an acceptance decision is made as a result of the continuity checking. The continuity checking section 164 of the control device 16 may be configured in such a manner that if a rejection decision is made as a result of the continuity checking, then that continuity checking section 164 displays alert information on the plurality of display devices 14 by means of the displaying control section 161 of the control device 16. If that rejection decision is made in the continuity checking, then the flow returns to step S16 to perform the continuity checking. Further, the continuity checking section 164 of the control device 16 may be configured in such a manner that if that rejection decision is repeatedly made a predetermined number of times in the continuity checking in step S16, then the flow returns to step S13, to redo the laying out of the first electric wire 11 to be laid out. In this case, that electric wire 11 having been rejected in the continuity checking is discarded.

After that acceptance decision has been made in the continuity checking in step S16, a scanning of the two-dimensional codes 182*a* on the mark tapes 182 attached to both the end portions, respectively, of that electric wire 11 (steps S17*a* and S17*b*) and a scanning of the bar codes 146 for an area label displayed on the plurality of display devices 14 (steps S18*a* and S18*b*) are performed at each of both the end portions of that electric wire 11, followed by a printing of the area label tapes 183 being performed by the two printers 18 (steps S19*a* and S19*b*). So, the operators attach those area label tapes 183 to predetermined places on that electric wire 11 and subsequently scan the two-dimensional codes 183*a* on those area label tapes 183 (steps S20*a* and S20*b*). By performing the above steps, the wire laying out operation of the first electric wire 11 is completed.

After that, in step S21, a cutting of the electric wire 11 to be next laid out is performed, while in steps S22*a* and 22*b*, a printing of the ring marks 181 and the mark tapes 182 of that electric wire 11 is performed. In addition, at this point of time, the bar codes 146 are displayed adjacent to both the end portions of that electric wire 11 to be laid out. The operators use, as markers, the wire laying out image data 171 and the bar codes 146 displayed on the plurality of display devices 14, and arrange that cut electric wire 11 while attaching the ring marks 181 and the mark tapes 182 to both the end portions of that electric wire 11. After that, in step S23, a continuity checking is performed. If a rejection decision is made as a result of the continuity checking, then the flow returns to step S23 to perform the continuity checking.

If an acceptance decision is made as a result of the continuity checking in step S23, then, in step S24, the control device 16 looks up the operation recipe information 172 and makes a decision as to whether that electric wire 11 having been subjected to the continuity checking is the last electric wire 11 to be laid out. If a Yes decision is made in step S24, then the flow progresses to step S29.

If a No decision is made in step S24, then, in step S25, the control device 16 looks up the operation recipe information 172, and makes a decision as to whether the next electric wire 11 to be laid out is the same in the area (the same in the area label) as that electric wire 11 currently being laid out, that is, that electric wire 11 having been subjected to the continuity checking in step S23. If a Yes decision is made in step S25, then the flow returns to steps S21, S22*a*, and S22*b*, to perform the wire laying out operation of the next electric wire 11.

If a No decision is made in step S25, then the displaying control section 161 of the control device 16 displays the bar codes 146 for the area label adjacent to both the end portions, respectively, of that electric wire 11 on the plurality of display devices 14. The operators perform a scanning of those bar codes 146 for the area label displayed on the plurality of display devices 14, at each of both the end portions of that electric wire 11 (Steps S26*a* and S26*b*), followed by a printing of the area label tapes 183 being performed by the two printers 18 (steps S27*a* and S27*b*). So, the operators attach those area label tapes 183 to predetermined places on that electric wire 11 and subsequently scan the two-dimensional codes 183*a* on those area label tapes 183 (steps S28*a* and S28*b*). After that, the flow returns to steps S21, S22*a*, and S22*b*, to perform the wire laying out operation of the next electric wire 11.

After finishing the wire laying out of all the electric wires 11, in step S29, the operators scan bar codes for a P/N label displayed on the plurality of display devices 14. Note that, prior to step S29, the displaying control section 161 of the control device 16 displays the bar codes for the P/N label on the plurality of display devices 14. When the operators have scanned the bar codes for the P/N label, the P/N labels are printed by the two printers 18 in step S30. Note that the P/N labels are a label configured to indicate a production number (a part number) of the wire harness, and to include a production number, a product name, a drawing number, and the like included in the operation recipe information 172 being printed on that label as character information and a two-dimensional code. Since the P/N labels are used to identify the entire wire harness, the P/N labels are attached to a trunk portion of the wire harness. After having attached the P/N labels to predetermined places on the wire harness, the operators scan the two-dimensional codes on the P/N labels in step S31.

After that, the displaying control section 161 of the control device 16 displays bar codes for start of a tape wrapping operation on the plurality of display devices 14. The operators scan the bar codes for start of the tape wrapping operation displayed on the plurality of display devices 14 in step S32. At this point of time, the positions for the tape wrapping are displayed on the plurality of display devices 14. The positions for the tape wrapping are indicated by a color or a frame or the like, for example. Further, the displaying control section 161 of the control device 16 displays bar codes for finish of the tape wrapping operation on the plurality of display devices 14. After having performed the tape wrapping operation, the operators scan the bar codes for finish of the tape wrapping operation in step S33.

When the operators have scanned the bar codes for finish of the tape wrapping operation, an incorrect electric wire detection program (Incorrect wire detection program) is started in step S34. The incorrect electric wire detection program is a program, which is configured to check whether the operating time is excessively short or long in comparison to the preset standard operating time, and check an incorrect operating order or an operation skipping, on the basis of the operation history information (the progress administration information 173).

After that, the displaying control section 161 of the control device 16 displays bar codes for start of a protective material mounting operation on the plurality of display devices 14. The operators scan the bar codes for start of the protective material mounting operation displayed on the plurality of display devices 14 in step S35. At this point of time, the positions for the protective material mounting are displayed on the plurality of display devices 14. The positions for the protective material mounting are indicated by, for example, a color or a frame or the like. Further, the displaying control section 161 of the control device 16 displays bar codes for finish of the protective material mounting operation on the plurality of display devices 14. After having performed the protective material mounting operation, the operators scan the bar codes for finish of the protective material mounting operation in step S36.

After that, the displaying control section 161 of the control device 16 displays bar codes for start of an inspection operation on the plurality of display devices 14. The operators scan the bar codes for start of the inspection operation displayed on the plurality of display devices 14 in step S37. After having performed the predetermined inspection operation, the operators scan bar codes for finish of the inspection operation in step S38. By performing the above steps, the wire harness is produced, and the wire laying out step is completed.

The times at which the bar codes 146, or the two-dimensional codes, or the like have been scanned in each of the above steps are stored in the storage section 17 of the control device 16 as the progress administration information 173, by the time recording portion 165. The progress status administrating section 214 of the administration server 21 is configured to appropriately update the progress information on the progress status display screen 51 on the basis of the progress administration information 173 having been stored in the storage section 17 of the control device 16. For example, the progress status administrating section 214 of the administration server 21 may be configured in such a manner as to update the progress information every time the bar codes 146 or the two-dimensional codes or the like have been scanned, or may be configured in such a manner as to update the progress information at appropriate time intervals.

Further, the operation history information may be configured in such a manner as to be created and stored on the basis of the progress administration information 173 having been stored in the storage section 17 of the control device 16 or the storage section 22 of the administration server 21. The operation history information refers to a data log configured to include the histories of the operations and the times taken for the operations summarized therein. For example, as shown in FIG. 16, the operation history information 174 is configured to include a Side for indicating a position of an end portion and denoting a connection destination area (e.g., a connection destination device or the like), an Item/Operation for denoting the electric wires 11 or the contents of the operations, a Date for denoting the times, an Additional Info for indicating details of the contents of the operations or the like, a length for denoting the electric wire lengths, the contents of the scans such as start/finish/check or the like, or a Scanned for denoting the results of the electric conductivity measurement in the continuity checking, a Time for denoting the operating times, and information such as More Info or the like for denoting other additional information. In FIG. 16, a Part Number denotes the production number of the wire harness, a Start denotes the production start time of the wire harness, a Finish denotes the production finish time of the wire harness, Operators denotes the operators IDs, and a Total denotes the time taken to produce the wire harness. Note that the information included in the operation history information 174 can be altered as appropriate.

(Actions and Advantageous Effects of the Embodiment)

As described above, the method for producing the wire harness according to the present embodiment is configured to include the compartmentalization step, which compartmentalizes the two-dimensional image 30 of the entire wire harness into the display regions 31 to be displayed on the respective display portions 141 of the plurality of display devices 14 respectively and the non-display regions 32 corresponding to the respective bezel portions 142 of the plurality of display devices 14 respectively, with the display regions 31 and the non-display regions 32 conforming to the sizes of the respective display portions 141 and the respective bezel portions 142, respectively, of the plurality of display devices 14, the wire laying out image data creation step, which trims the compartmentalized two-dimensional image 30 to create the image data composed of only the display regions 31 for the wire laying out drawing 143, in other words, the wire laying out image data 171, and the wire laying out drawing displaying step, which displays the wire laying out drawing 143 on each of the plurality of displays 14, on the basis of the wire laying out image data 171 having been created.

As a result, it is possible to create the wire laying out image data 171 conforming to the sizes of the plurality of display devices 14 to be used, and it is therefore possible to efficiently utilize that plurality of display devices 14 and thereby efficiently produce the wire harness. For example, in a typical multi-display technique, typically, the non-display regions 32 corresponding to the respective bezel portions 142 of the plurality of display devices 14 are not cut away, but in the wire harness producing device 10, since the wire laying out drawing 143 is displayed in such a manner as to straddle the plurality of display devices 14, it is necessary to display the wire laying out drawing 143 in a full size as a whole, also allowing for the sizes of the respective bezel portions 142 of the plurality of display devices 14. As in the present embodiment, by including the compartmentalization step and the wire laying out image data creation step, the wire harness producing method and device enables the wire laying out drawing 143 to be displayed in a full size (in an actual size) as a whole.

In addition, by forming the wire laying out image data 171 conforming to the sizes of the plurality of display devices 14, it is possible to easily use the wire harness producing method and device for various forms of the arrangement of the plurality of display devices 14, and it is therefore possible to more efficiently utilize that plurality of display devices 14. Further, according to the present embodiment, it is possible to use the inexpensive display devices 14 having their relatively large bezel portions 142, and it is therefore possible to display the precise size wire laying out drawing 143 on that plurality of display devices 14 even without using an expensive display device having a very small bezel portion 142.

SUMMARY OF THE EMBODIMENT

Next, the technical ideas grasped from the above-described embodiments will be described with the aid of the reference characters and the like in the embodiments. It should be noted, however, that each of the reference characters and the like in the following descriptions is not to be construed as limiting the constituent elements in the appended claims to the members and the like specifically shown in the embodiments.

[1] A wire harness producing method, which is configured to produce a wire harness by arranging a plurality of display devices (14) end to end, each configured to include a display portion (141) and a bezel portion (142) arranged around a periphery of the display portion (141), displaying a wire laying out drawing (143) in a full size in a length direction on the plurality of display devices (14), and laying out an electric wire (11) along the wire laying out drawing (143), the method comprising: compartmentalizing a pre-created two-dimensional image (30) of the entire wire harness into display regions (31) to be displayed on the respective display portions (141) of the plurality of display devices (14) respectively and non-display regions (32) corresponding to the respective bezel portions (142) of the plurality of display devices (14) respectively, with the display regions (31) and the non-display regions (32) conforming to sizes of the respective display portions (141) and the respective bezel portions (142), respectively, of the plurality of display devices (14); trimming the two-dimensional image (30) to create wire laying out image data (171) composed of only the display regions (31) for the wire laying out drawing (143); and displaying the wire laying out drawing (143) on the plurality of display devices (14) on the basis of the wire laying out image data (171) having been created.

[2] The wire harness producing method as defined in [1] above, further comprising: creating the two-dimensional image (30) in such a manner that an end portion of the electric wire (11) in the two-dimensional image (30) is not included in the non-display regions (32).

[3] The wire harness producing method as defined in [1] or [2] above, further comprising: creating the two-dimensional image (30) in such a manner that a branching portion of the electric wire (11) in the two-dimensional image (30) is not included in the non-display regions (32).

[4] The wire harness producing method as defined in any one of [1] to [3] above, wherein the step of displaying the wire laying out drawing (143) is performed in such a manner that, if there are one or more of the plurality of display devices (14) with no wire laying out drawing (143) being displayed thereon, the one or more of the plurality of display devices (14) with no wire laying out drawing (143) being displayed thereon switch to a sleep mode or a power saving mode, or power off.

[5] The wire harness producing method as defined in any one of [1] to [4] above, wherein the step of displaying the wire laying out drawing (143) is performed in such a manner as to allow a plurality of the wire harnesses having lengths to be displayed on the plurality of display devices (14) arranged end to end, in accordance with the lengths of the plurality of the wire harnesses to be laid out.

[6] The wire harness producing method as defined in any one of [1] to [5] above, wherein the plurality of display devices (14) are arranged end to end in one row, and one end portion in a direction of the arrangement of the plurality of display devices (14) arranged end to end in one row is set as a reference end portion which serves as a reference during wire laying out, wherein production information including information on the wire harness to be produced is displayed on one of the plurality of display devices (14) being arranged closest to the reference end portion, but no image of the wire harness is displayed on the one of the plurality of display devices (14) being arranged closest to the reference end portion.

[7] The wire harness producing method as defined in any one of [1] to [5] above, wherein the plurality of display devices (14) are arranged in rows and columns in a matrix.

[8] The wire harness producing method as defined in any one of [1] to [7] above, wherein the step of displaying the wire laying out drawing (143) is performed in such a manner as to use one or more graphics cards (167) and a plurality of separators (168) connected to the one or more graphics cards (167) and to the plurality of display devices (14), to send outputs of the one or more graphics cards (167) by means of the plurality of separators (168) to the plurality of display devices (14).

[9] The wire harness producing method as defined in [8] above, wherein lengths of cables connecting the one or more graphics cards (167) and the plurality of separators (168) are longer than lengths of cables connecting the plurality of separators (168) and the plurality of display devices (14).

[10] The wire harness producing method as defined in any one of [1] to [9] above, wherein plate-shape transparent protecting covers (144) are provided on the plurality of display devices (14), respectively, in such a manner as to cover uneven surfaces between the respective display portions (141) and the respective bezel portions (142) of the plurality of display devices (14) to protect the respective display portions (141) of the plurality of display devices (14), so that the electric wire (11) is laid out on those transparent protecting covers (144).

[11] The wire harness producing method as defined in [10] above, wherein the transparent protecting covers (144) for the respective display portions (141) of the plurality of display devices (14) are each individually being provided for each of the plurality of display devices (14).

[12] The wire harness producing method as defined in [10] or [11] above, wherein joined portions between adjacent ones of the transparent protecting covers (144) for the respective display portions (141) of the plurality of display devices (14) are provided with protective tapes (145), respectively, to suppress an interference of the electric wire (11) to be laid out with end portions of the transparent protecting covers (144).

[13] The wire harness producing method as defined in any one of [10] to [12] above, wherein the transparent protecting covers (144) for the respective display portions (141) of the plurality of display devices (14) are each being configured to include a blue light blocking layer to attenuate or block blue light.

[14] A wire harness producing device, which is configured to produce a wire harness by arranging a plurality of display devices (14) end to end, each configured to include a display portion (141) and a bezel portion (142) arranged around a periphery of the display portion (141), displaying a wire laying out drawing (143) in a full size on the plurality of display devices (14), and laying out an electric wire (11) along the wire laying out drawing (143), the device comprising: a compartmentalizing section (212) configured to compartmentalize a pre-created two-dimensional image (30) of the entire wire harness into display regions (31) to be displayed on the respective display portions (141) of the plurality of display devices (14) respectively and non-display regions (32) corresponding to the respective bezel portions (142) of the plurality of display devices (14) respectively, with the display regions (31) and the non-display regions (32) conforming to sizes of the respective display portions (141) and the respective bezel portions (142), respectively, of the plurality of display devices (14); a wire laying out image data creating section (213) configured to trim the two-dimensional image (30) to create wire laying out image data (171) composed of only the display regions (31) for the wire laying out drawing (143); and a displaying control section (161) configured to display the wire laying out drawing (143) on the plurality of display devices (14) on the basis of the wire laying out image data (171) having been created in the wire laying out image data creating section (213).

Although the embodiments of the present invention have been described above, the above described embodiments are not to be construed as limiting the inventions according to the appended claims. Further, it should be noted that not all the combinations of the features described in the embodiments are indispensable to the means for solving the problem of the invention.

Further, the present invention can be appropriately modified and implemented without departing from the spirit thereof. For example, although in the above-described embodiment, a case in which the wire harness designed for the train vehicle is produced has been described, the present invention is not limited to the above case, but can also produce the wire harness designed for a use application other than for the train vehicle.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A wire harness producing method, which is configured to produce a wire harness by arranging a plurality of display devices end to end, each of the display devices being configured to include a display portion and a bezel portion arranged around a periphery of the display portion, displaying a wire laying out drawing in a full size in a length direction on the plurality of display devices, and laying out an electric wire along the wire laying out drawing, the method comprising:

compartmentalizing a pre-created two-dimensional image of the entire wire harness into display regions to be displayed on the respective display portions of the plurality of display devices respectively and non-display regions corresponding to the respective bezel portions of the plurality of display devices respectively, with the display regions and the non-display regions conforming to sizes of the respective display portions and the respective bezel portions, respectively, of the plurality of display devices;

trimming the two-dimensional image to create wire laying out image data composed of only the display regions for the wire laying out drawing; and displaying the wire laying out drawing on the plurality of display devices on the basis of the wire laying out image data having been created, wherein, plate-shaped transparent protecting covers are respectively provided on the plurality of display devices in such a manner as to cover uneven surfaces between the respective display portions and the respective bezel portions of the plurality of display devices to protect the respective display portions and the respective bezel portions of the plurality of display devices, so that the electric wire is laid out on the transparent protecting covers, in a stacking direction of the plate-shaped transparent protecting covers on the respective display portions of the plurality of display devices, the plate-shaped transparent protecting covers overlapping with the respective bezel portions of the plurality of display devices.

2. The wire harness producing method according to claim 1, further comprising:

creating the two-dimensional image in such a manner that an end portion of the electric wire in the two-dimensional image is not included in the non-display regions.

3. The wire harness producing method according to claim 1, further comprising:

creating the two-dimensional image in such a manner that a branching portion of the electric wire in the two-dimensional image is not included in the non-display regions.

4. The wire harness producing method according to claim 1, wherein, displaying the wire laying out drawing is performed in such a manner that, if there are one or more of the plurality of display devices with no wire laying out drawing being displayed thereon, the one or more of the plurality of display devices with no wire laying out drawing being displayed thereon switch to a sleep mode or a power saving mode, or power off.

5. A wire harness producing method, which is configured to produce a wire harness by arranging a plurality of display devices end to end, each of the display devices being configured to include a display portion and a bezel portion arranged around a periphery of the display portion, displaying a wire laying out drawing in a full size in a lenath direction on the plurality of display devices, and laying out an electric wire along the wire laying out drawing, the method comprising:

compartmentalizing a pre-created two-dimensional image of the entire wire harness into display devices to be displayed on the respective display portions of the plurality of display devices respectively and non-display regions corresponding to the respective bezel portions of the plurality of display devices respective display regions and the non-display regions conforming to sizes of the respective display portions and the respective bezel portions, respectively, of the plurality of display devices;

trimming the two-dimensional image to create wire laying out image data composed of only the display regions for the wire laving out drawing; and displaying the wire laying out drawing on the plurality of display devices on the basis of the wire laying out image data having been created, wherein displaying of the wire laying out drawing is performed in such a manner as to allow a plurality of the wire harnesses having lengths to be displayed on the plurality of display devices arranged end to end, in accordance with the lengths of the plurality of the wire harnesses to be laid out.

6. The wire harness producing method according to claim 1, wherein the plurality of display devices are arranged end to end in one row, and one end portion in a direction of the arrangement of the plurality of display devices arranged end to end in one row is set as a reference end portion which serves as a reference during wire laying out, wherein production information including the information of the wire harness plurality of display devices being arranged closest to the reference end portion, but no image of the wire harness is displayed on the one of the plurality of display devices being arranged closest to the reference end portion.

7. The wire harness producing method according to claim 1, wherein the plurality of display devices are arranged in rows and columns in a matrix.

8. The wire harness producing method according to claim 1, wherein displaying the wire laying out drawing is performed in such a manner as to use one or more graphics cards and a plurality of separators connected to the one or more graphics cards and to the plurality of display devices, to send outputs of the one or more graphics cards by the plurality of separators to the plurality of display devices.

9. The wire harness producing method according to claim 8, wherein lengths of cables connecting the one or more graphics cards and the plurality of separators are longer than lengths of cables connecting the plurality of separators and the plurality of display devices.

10. The wire harness producing method according to claim 1, wherein the transparent protecting covers for the respective display portions of the plurality of display devices are each individually being provided for each of the plurality of display devices.

11. The wire harness producing method according to claim 1, wherein joining portions between adjacent ones of the transparent protecting covers for the respective display portions of the plurality of display devices are provided with protective tapes to suppress an interference of the electric wire to be laid out with end portions of the transparent protecting covers.

12. The wire harness producing method according to claim 1, wherein the transparent protecting covers for the respective display portions of the plurality of display devices are each being configured to include a blue light blocking layer to attenuate or block blue light.

13. A wire harness producing device, which is configured to produce a wire harness by arranging a plurality of display devices end to end, each of the display devices being configured to include a display portion and a bezel portion arranged around a periphery of the display portion, displaying a wire laying out drawing in a full size on the plurality of display devices, and laying out an electric wire along the wire laying out drawing, the device comprising:

a server communicating to a processor of a computer compartmentalizes a pre-created two-dimensional image of the entire wire harness into display regions to be displayed on the respective display portions of the plurality of display devices respectively and non-display regions corresponding to the respective bezel portions of the plurality of display devices respectively, with the display regions and the non-display regions conforming to sizes of the respective display portions and the respective bezel portions, respectively, of the plurality of display devices; and trim the two-dimensional image to create wire laying out image data composed of only the display regions for the wire laying out drawing, wherein the processor is configured to display the wire laying out drawing on the plurality of display devices on the basis of the wire laying out image data having been created in the server, and wherein plate-shaped transparent protecting covers are respectively provided on the plurality of display devices in such a manner as to cover uneven surfaces between the respective display portions and the respective bezel portions of the plurality of display devices to protect the respective display portions and the respective bezel portions of the plurality of display devices, so that the electric wire is laid out on the transparent protecting covers, in a stacking direction of the plate-shaped transparent protecting covers on the respective display portions of the plurality of display devices, the plate-shaped transparent protecting covers overlapping with the respective bezel portions of the plurality of display devices.

14. The wire harness producing method according to claim 1, wherein each of the transparent protecting covers for the respective display portions of the plurality of display devices is individually provided for each of the plurality of display devices.

15. The wire harness producing method according to claim 14, wherein joining portions between the adjacent ones of the transparent protecting covers for the plurality of display devices are located on the respective bezel portions of the plurality of display devices.

16. The wire harness producing device according to claim 13, wherein each of the transparent protecting covers for the respective display portions of the plurality of display devices is individually provided for each of the plurality of display devices.

17. The wire harness producing device according to claim 16, wherein joining portions between the adjacent ones of the transparent protecting covers for the plurality of display devices are located on the respective bezel portions of the plurality of display devices.

* * * * *